US011490776B2

(12) United States Patent
Jang et al.

(10) Patent No.: US 11,490,776 B2
(45) Date of Patent: Nov. 8, 2022

(54) CLEANER

(71) Applicant: LG ELECTRONICS INC., Seoul (KR)

(72) Inventors: Jaewon Jang, Seoul (KR); Sungho Yoon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 146 days.

(21) Appl. No.: 16/963,022

(22) PCT Filed: Jan. 18, 2019

(86) PCT No.: PCT/KR2019/000750
§ 371 (c)(1),
(2) Date: Jul. 17, 2020

(87) PCT Pub. No.: WO2019/143172
PCT Pub. Date: Jul. 25, 2019

(65) Prior Publication Data

US 2020/0345194 A1 Nov. 5, 2020

(30) Foreign Application Priority Data

Jan. 19, 2018 (KR) ..... 10-2018-0007093

(51) Int. Cl.
*A47L 11/40* (2006.01)
*A47L 11/283* (2006.01)

(52) U.S. Cl.
CPC ..... *A47L 11/4011* (2013.01); *A47L 11/283* (2013.01); *A47L 11/4013* (2013.01);
(Continued)

(58) Field of Classification Search
CPC ..... A47L 11/283; A47L 11/4038; A47L 11/4069; A47L 11/4083; A47L 11/4088;
(Continued)

(56) References Cited

U.S. PATENT DOCUMENTS 9,474,427 B2 10/2016 Lee et al.

FOREIGN PATENT DOCUMENTS

EP 2918212 9/2015
EP 2921095 9/2015
(Continued)

OTHER PUBLICATIONS

International Search Report (with English Translation) and Written Opinion dated May 16, 2019 issued in Application No. PCT/KR2019/000750.

(Continued)

*Primary Examiner* — Randall E Chin
(74) *Attorney, Agent, or Firm* — Ked & Associates, LLP

(57) ABSTRACT

Disclosed is a cleaner capable of autonomously traveling while performing a mopping task, the cleaner including: a body which defines an exterior appearance of the cleaner; at least one mop module which has at least one mop provided in contact with a floor, and which supports the body against the floor; and a tilt information acquisition unit configured to acquire tilt information of the body in relation to the floor. At least one specific part may comprise the at least one mop, may be a whole or part of the at least one mop module, and may be defined such that the at least one specific part is provided detachable from other parts of the cleaner except for the at least one specific part and that the body tilts in relation to the floor due to gravity while the at least one specific part is separated from the other parts. The cleaner may further comprises a controller which is configured to: based on at least the tilt information, determine satisfaction or unsatisfaction of a predetermined separated condition that is preset to be satisfied when the specific part is separated from the other parts; and, when the detachments condition is satisfied, control a predetermined mop separation error response operation.

19 Claims, 26 Drawing Sheets

(52) U.S. Cl.
CPC ..... *A47L 11/4038* (2013.01); *A47L 11/4044* (2013.01); *A47L 11/4063* (2013.01); *A47L 11/4083* (2013.01); *A47L 11/4088* (2013.01)

(58) Field of Classification Search
CPC ..... A47L 2201/00; A47L 13/282; A47L 13/292–293; A47L 11/282; A47L 11/292–293; B25J 11/0085
See application file for complete search history.

(56) References Cited

FOREIGN PATENT DOCUMENTS

| | | | |
|---|---|---|---|
| JP | H 09-224883 | A | 9/1997 |
| KR | 10-1369225 | B1 | 3/2014 |
| KR | 10-2015-0109598 | A | 10/2015 |
| KR | 10-2016-0090567 | A | 8/2016 |
| KR | 10-2016-0090571 | A | 8/2016 |
| TW | 201625170 | | 7/2016 |

OTHER PUBLICATIONS

Taiwanese Office Action dated Oct. 19, 2020 issued in Application No. 108101858.
European Search Report dated Oct. 6, 2021 issued in Application No. 19740691.1.

| Embodiment | P | Q |
|---|---|---|
| 1 | 40 | 10, 50 |
| 1' | 40 | 10 |

| Embodiment | P | Q |
|---|---|---|
| 1 | 40a" | 10, 50, 40b" |
| | 40b" | 10, 50, 40a" |
| | 40" | 10, 50 |
| 1' | 40a" | 10, 40b" |
| | 40b" | 10, 40a" |
| | 40" | 10 |

| Embodiment | P | Q |
|---|---|---|
| 1 | 41a''' | 10, 50, 40F''', 41b''' |
| | 41b''' | 10, 50, 40F''', 41a''' |
| | 41''' | 10, 50, 40F''' |
| 1' | 41a''' | 10, 40F''', 41b''' |
| | 41b''' | 10, 40F''', 41a''' |
| | 41''' | 10, 40F''' |

| Embodiment | P | Q |
|---|---|---|
| 1 | 411a | 10, 50, 40G, 411b |
| | 411b | 10, 50, 40G, 411a |
| | 411 | 10, 50, 40G |
| 1' | 411a | 10, 40G, 411b |
| | 411b | 10, 40G, 411a |
| | 411 | 10, 40G |

CLEANER

CROSS-REFERENCE TO RELATED PATENT APPLICATIONS

This application is a U.S. National Stage Application under 35 U.S.C. § 371 of PCT Application No. PCT/KR2019/000750, filed Jan. 18, 2019, which claims priority to Korean Patent Application No. 10-2018-0007093, filed Jan. 19, 2018, whose entire disclosures are hereby incorporated by reference.

BACKGROUND OF THE INVENTION

1. Field of the Invention

The present invention relates to a cleaner capable of performing a mopping task.

2. Description of the Related Art

A cleaner is an apparatus that cleans a floor by absorbing or sweeping foreign substances from the floor. Recently, cleaners capable of mopping a floor have been being developed. In addition, a robot cleaner is an apparatus that cleans a floor while autonomously traveling the floor.

An existing technology (Korean Patent No. 10-1654014) has been published to disclose a robot cleaner capable of moving by a mop surface. In the existing technology, the robot cleaner includes first and second rotating members for fixing a pair of mop surfaces disposed in the left-right direction. In the robot cleaner according to the existing technology, the first and second rotating members are detachably coupled to a robot body.

RELATED ART DOCUMENT

Patent Document

Korean Patent Publication No. 10-1654014 (Registered on Aug. 30, 2016)

SUMMARY OF THE INVENTION

In the existing technology, the robot cleaner is not capable of detecting whether the first and second rotating members are separated. Specifically, if the cleaner keeps trying to travel even though a mop is separated from the cleaner, it may cause an unnecessary waste of power consumption and leave a floor surface scratched. A first object of the present invention is to solve this problem.

For wet cleaning, it is necessary to control water supply before traveling. Thus, it is required to recognize separation of a mop before water is supplied. Otherwise, despite separation of a mop from a cleaner, the cleaner would supply water to the mop and leak water to a floor, causing user inconvenience. A second object of the present invention is to solve this problem.

In the existing technology, when a mop is obstructed by an obstacle, the robot cleaner is not able to respond to the obstruction and thus there is a limitation in managing the robot cleaner. A third object of the present invention is to solve this problem.

A third object of the present invention is to determining whether a mop is separated or obstructed, by using only essential sensors required for autonomous traveling of a robot cleaner.

Information detected by a robot cleaner may be affected by different factors according to diverse situations. A fifth object of the present invention is to enable a robot cleaner to accurately and efficiently recognize such diverse situations.

To achieve the first and second objects, the present invention provides a cleaner capable of recognizing whether or not a specific part, including a mop, is separated.

To achieve the first and second objects, the present invention provides a cleaner capable of recognizing whether or not a specific part, including a mop, is separated even in the case where the cleaner is not moving.

To achieve the third objective, the present invention provides a cleaner capable of recognizing whether or not a mop is obstructed by an obstacle even in the case where the cleaner is not moving.

To achieve the fourth objective, the present invention provides a cleaner capable of making a specific determination using a tilt information acquisition unit and/or a load information acquisition unit required for autonomous traveling.

To achieve the fifth objective, the present invention is to enable a cleaner to recognize a situation more accurately and efficiently by changing an algorithm, which is for determining whether or not a mop is separated and/or obstructed, according to a time related to a traveling operation.

In one general aspect of the invention, there is provided a cleaner capable of autonomously traveling while performing a mopping task, the cleaner including: a body which defines an exterior appearance of the cleaner; at least one mop module which has at least one mop provided in contact with a floor, and which supports the body against the floor; and a tilt information acquisition unit configured to acquire tilt information of the body in relation to the floor. At least one specific part may include the at least one mop, may be a whole or part of the at least one mop module, and may be defined such that the at least one specific part is provided detachable from other parts of the cleaner except for the at least one specific part and that the body tilts in relation to the floor due to gravity while the at least one specific part is separated from the other parts. The cleaner may further include a controller which is configured to: based on at least the tilt information, determine satisfaction or unsatisfaction of a predetermined detachments condition that is preset to be satisfied when the specific part is separated from the other parts; and control a predetermined mop separation error response operation when the detachments condition is satisfied.

The detachments condition may include a tilt condition that is preset such that satisfaction and unsatisfaction thereof is to be determined by comparing a tilt value corresponding to the tilt information with a predetermined reference tilt value.

The cleaner may further include: a mop motor which is configured to provide a rotational force to the at least one mop; and a load information acquisition unit which is configured to acquire load information of the at least one mop motor.

The detachments condition may include a low load condition that is preset to be satisfied when a load value corresponding to the load information is relatively low, and not to be satisfied when the load value is relatively high.

The detachments condition may be preset to be satisfied at least when the tilt condition and the low load condition are all satisfied.

The tilt condition may be preset to be satisfied when the tilt value is greater than a predetermined low limit reference tilt value and smaller than a predetermined high limit reference tilt value.

The controller may be further configured to, when the tilt condition is changed from an unsatisfied state to a satisfied state, control a predetermined avoidance operation to be performed.

The cleaner may reserve determination as to satisfaction or unsatisfaction of the detachments condition until the avoidance operation is terminated by a predetermined standard.

The the controller may be further configured to, when i) the low load condition and ii) the tilt condition are all satisfied, control the mop separation error response operation to be performed.

The controller may be further configured to: based on at least the load information, determine satisfaction or unsatisfaction of a predetermined obstructed condition that is preset to be satisfied when the at least one mop is obstructed by an external obstacle; and, when the obstructed condition is satisfied, control a predetermined mop obstruction error response operation, which is different from a mop separation error response operation, to be performed.

The obstructed condition may include a high load condition which is preset to be satisfied when a load value corresponding to the load information is relatively high, and not to be satisfied when the load value is relatively low The obstructed condition may include a tilt condition which is preset such that satisfaction or unsatisfaction thereof is to be determined by comparing a tilt value corresponding to the tilt information with a predetermined reference tilt value. The obstructed condition may be preset to be satisfied at least when the tilt condition and the high load condition are all satisfied.

The detachments condition and the obstructed condition may include the tilt condition, and the detachments condition and the obstructed condition may be set to be different.

The at least one specific part may comprise a plurality of different specific parts. The tilt information may include information about a tilt value and a tilt direction. The controller may be further configured to, based on the tilt value and the tilt direction, recognize which specific part is separated among the plurality of different specific parts.

The body may tilt in relation to the floor due to gravity while the mop module is separated from other parts of the cleaner except for the mop module. The controller may further configured to, based on at least the tilt information, determine satisfaction or unsatisfaction of a predetermined detachments condition that is preset to be satisfied when the mop module is separated from the other parts.

In another general aspect of the present invention, there is provided a cleaner capable of autonomously traveling while performing a mopping task, the cleaner including: a body which defines an exterior appearance of the cleaner; at least one mop module which comprises at least one mop provided to be rotatably in contact with a floor, and which is coupled to the body; at least one mop motor configured to provide a rotational force to the at least one mop; and a load information acquisition unit which is configured to acquire load information of the at least one mop motor. At least one specific part may include the at least one mop, may be a whole or part of the at least one mop module, and may be defined such that the at least one specific part is provided detachable from other parts of the cleaner except for the specific part while the at least one mop motor is disposed at the other parts. The cleaner may further include a controller which is configured to: based on at least the load information, determine satisfaction or unsatisfaction of a detachments condition that is preset to be satisfied when the specific part is separated from the other parts; and, when the detachments condition is satisfied, control a predetermined mop separation error response operation.

The detachments condition may include the low load condition.

The controller may be further configured to: based on at least the load information, determine satisfaction or unsatisfaction of a predetermined obstructed condition that is preset to be satisfied when the at lest one mop is obstructed by an external obstacle; and, when the obstructed condition is satisfied, control a predetermined mop obstruction error response operation, which is different from a predetermined mop separation error response operation, to be performed.

The obstructed condition may include the high load condition.

The low load condition and the high load condition may be preset not to be satisfied at the same time.

The at least one mop motor may include a plurality of mop motors which is configured to provide a rotational force to the plurality of mops, respectively. The load information acquisition unit may acquire load information of each of the plurality of mop motors. The at least one specific part may include a plurality of different specific parts. The controller may recognize which specific part comprising which mop from among the plurality of mops is separated, based on the load information of each of the plurality of mop motors.

The at least one mop motor may be disposed at the body. The controller may be further configured to, based on at least the load information, determine satisfaction or unsatisfaction of a predetermined separation condition that is preset to be satisfied when the mop module is separated from the body.

In doing so, the cleaner is able to recognize separation of the specific part and respond to the separation, thereby preventing an unnecessary power consumption, errors of a device, and scratches on the floor and even avoiding a situation in which water is supplied when a mop is separated.

By determining satisfaction or unsatisfaction of the detachments condition using the tilt information acquisition unit, it is possible to achieve the above objects even without using any other sensor in addition to a sensor essential for autonomous traveling.

By determining satisfaction or unsatisfaction of the detachments condition using the load information acquisition unit, it is possible to achieve the above objects even without using any other sensor in addition to the load information acquisition unit essential to control a motor.

As the controller makes a determination by combining all information acquired by the tilt information acquisition unit and the load information acquisition unit, it is possible to recognize the current situation more accurately, recognize a variety of situations, and determine the obstructed condition as well as the detachments condition.

The cleaner is controlled to perform a predetermined avoidance operation when the tilt condition is satisfied during traveling of the cleaner, and therefore, even when one side of the cleaner is lifted by an external obstacle, the mop separation error operation is prevented from being performed unnecessarily. In addition, when one side of the cleaner is lifted by an external obstacle, the cleaner is controlled to avoid the corresponding obstacle.

BRIEF DESCRIPTION OF THE DRAWINGS

FIG. 2A is a perspective view of a mop module 40 detachably provided in the cleaner 1 or 1' according to a first detachment embodiment of the cleaner 1 or 1' of FIG. 1A or 1B.

FIG. 2B is a perspective view of a pair of mop modules 40" detachably provided in the cleaner 1 or 1' according to a second detachment embodiment of the cleaner 1 or 1' of FIG. 1A or 1B.

FIG. 2C is a perspective view of a pair of mop units 41''' detachably provided in the cleaner 1 or 1' according to a third detachment embodiment of the cleaner 1 or 1' of FIG. 1A or 1B.

FIG. 2D is a perspective view of a pair of mops 411 detachably provided in the cleaner 1 or 1' according to a fourth detachment embodiment of the cleaner 1 or 1' of FIG. 1A or 1B.

FIG. 3A is an elevation view showing a first exemplary situation in which the specific part P is defined as a mop module 40 and in which the body 30 belonging to other parts Q tilt in relation to the floor H when the specific part is separated.

FIG. 3B is an elevation view showing a second exemplary situation in which the specific part P is defined as a first mop module 40*a*" and in which the body 30 belonging to other parts Q tilt in relation to the floor H when the specific part P is separated.

FIG. 3C is an elevation view showing a third exemplary situation in which the specific part P is defined as a second mop unit 41*b*''' and in which the body 30 belonging to other parts Q tilt in relation to the floor H when the specific part P is separated.

FIG. 3D is an elevation view showing a fourth exemplary situation in which the specific part P is defined as a second mop unit 411*a* in the cleaner 1 or 1' of FIG. 2D and in which the body 30 belonging to other parts Q tilt in relation to the floor H when the specific part P is separated.

FIG. 4 is a perspective view of the body 30 and the mop module 40, being separated from the cleaner 1, from a different angle of view.

FIG. 5 is an elevation view of a rear side of the cleaner 1.

FIG. 6 is an elevation view of a bottom side of the cleaner 1.

FIG. 7 is a cross-sectional view of the cleaner 1 vertically cut along line S1-S1' of FIG. 6.

FIG. 8 is a perspective view showing the cleaner 1 from which a case 31 and a water tank 81 are removed.

FIG. 9 is a cross-sectional view of the left side of the mop module 40 of the cleaner 1 by a vertical plane which passes a water supply correspondence part 411 and a slave joint 415.

FIG. 10 is an exploded perspective view of the mop module 40 of the cleaner 1.

FIG. 11 is an exploded perspective view of the mop module 40 of FIG. 10 from a different angle of view.

DETAILED DESCRIPTION OF THE EMBODIMENTS

Figure 1A:
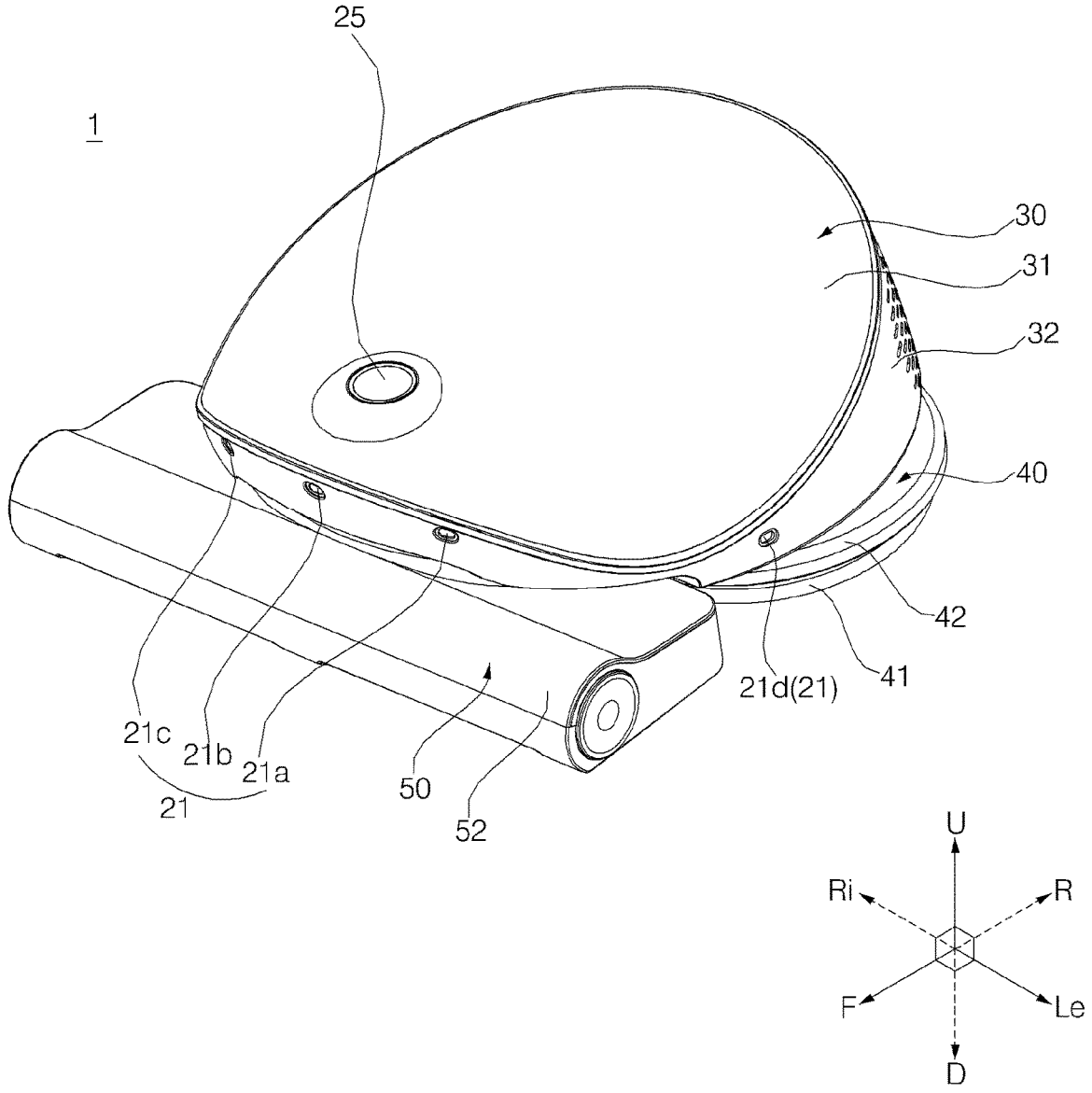
FIG. 1A is a perspective view of a cleaner (1) according to an embodiment A of the present invention.

Hereinafter, the "forward"/"rearward"/"leftward"/"rightward"/"upward"/"downward" directions set forth herein are defined as shown in each drawing, but these directions are used merely to clearly describe the present invention, and the above directions may be differently defined as needed.

It will be understood that the terms first, second, third etc. are used herein to distinguish elements from one another, regardless of elements' order, importance, or master-slave relationship. For example, the prevent invention may be implemented as including a second element alone, without a first element.

As used herein, the singular forms "a," "an" and "the" are intended to include the plural forms as well, unless the context clearly indicates otherwise.

A mop used herein may be any of various materials in terms of texture, such as a cloth and a paper, and may be reusable by washing it or disposable.

Hereinafter, a cleaner 1 according to embodiments of the present invention will be broadly described with reference to FIGS. 1A to 12.

The cleaner 1 according to embodiments of the present invention may be capable of performing a mopping task. The cleaner 1 may be provided to be capable of autonomously traveling.

The cleaner 1 includes a body 30 that defines an exterior appearance of the cleaner 1. The cleaner 1 includes at least one mop 411 that is provided to be in contact with an external floor (horizontal plane) H. The cleaner 1 may include at least one mop module 40 including the at least one mop 411.

The mop module 40 supports the body 30 against the floor. The mop module 40 is coupled to the body 30. The mop module 40 may be disposed below the body 30.

The mop module 40 include at least one mop 411 provided to rotate in contact with the floor H. The mop 411 may be provided to rotatably mop the floor. The mop module 40 may include a plurality of mops 411*a* and 411*b*. The plurality of mops 411 may include a first mop 411*a* and a second mop 411*b* arranged in the left-right direction.

The mop module 40 may include at least one mop unit 41 to which the mop 411 is fixed and which transfers a rotational force to the mop 411. The mop unit 41 is in contact with the floor while rotating in a clockwise direction or in a counter-clockwise direction, as viewed above. The mop module 40 may include a plurality of mop units 41*a* and 41*b* respectively corresponding to the plurality of mops 411*a* and 411*b*. The plurality of mop units 41*a* and 41*b* may include a first mop unit 41*a* and a second mop unit 41*b* arranged in the left-right direction. In this embodiment, the mop units 41*a* and 41*b* are provided to rotate about rotation axes Osa and Osb extending substantially in the upward-downward direction.

The cleaner 1 includes a mop driving unit 60 that provides a driving force of the mop module 40. A rotational force provided by the mop driving unit 60 is transferred to the mop unit 41. The driving force provided by the mop driving unit 60 is consequently transferred to the mop 411.

The mop driving unit 60 include at least mop motor 61 that provides a rotational force to the mop 411. The at least one mop motor 51 may include a plurality of mop motors 61*a* and 61*b* that provides a rotational force to the plurality of mops 411*a* and 411*b*, respectively.

The cleaner 1 includes a water supply module 80 that supplies water necessary for a mopping task. The water supply module 80 includes a water tank 81 for storing water.

The water supply module 80 may supply water necessary for the mop module 40. The water supply module 80 may supply water to the mop 411. The mop module 40 may be provided to perform wet mopping (which means mopping while supplying water).

The cleaner 1 includes a battery Bt for supplying power. The battery Bt may provide power to the mop driving unit 60.

The cleaner 1 or 1' includes a sensing unit 20 that senses various kinds of information related to an operation or state of the cleaner 1 or 1' or an exterior situation.

The sensing unit 20 may include an obstacle sensor 21 that detects an obstacle spaced apart from the cleaner 1 or 1'. A plurality of obstacle sensors 21*a*, 21*b*, 21*c*, and 21*d* may be provided. The obstacle sensor 21 includes obstacle sensors 21*a*, 21*b*, and 21*c* that detect an obstacle located in the front. The obstacle sensor 21 includes an obstacle sensor 21*d* that detects an obstacle located on the left or right side. The obstacle sensor 21 may be disposed at the body 30. The obstacle sensor 21 may include an infrared sensor, an ultrasonic sensor, a Radio Frequency (RF) sensor, a geomagnetic sensor, a Position Sensitive Device (PSD) sensor, etc.

The sensing unit 20 may include a location signal sensor 22 that determines a location by receiving an identification signal from the outside. For example, the location signal sensor 22 may be an Ultra Wide Band (UWB) sensor that utilizes an UWB signal. The controller 10 may locate the cleaner 1 or 1' based on a signal received by the location signal sensor 22.

The identification signal from the outside is a signal transmitted by a signal generator, such as a beacon disposed outside, and a plurality of signal generators may be provided at different locations spaced apart from each other. The location signal sensor 22 is able to receive identification signals transmitted by signal generators disposed at different locations.

The sensing unit 20 may include a cliff sensor 23 that detects existence of a cliff on a floor. The cliff sensor 23 may detect existence/absence of a cliff in the front and/or the rear of the cleaner 1 or 1'.

The sensing unit 20 may include a camera 24 that senses an image of the outside. The camera 24 may be disposed at the body 30. The camera 24 may sense an image of an area above the body 30.

The sensing unit 20 may include a three-dimensional (3D) sensor 25 that perceives 3D location information of an external environment.

In one example, a 3D sensor 135 may include a light emitting unit (not shown) for emitting an infrared ray, and a 3D depth camera (not shown) for sensing the infrared ray reflected by an external object. The light emitting unit may emit an infrared ray having a specific pattern. The 3D camera may be an IR camera, a RGB-Depth camera, or the like. The 3D sensor 135 may be implemented by a Time of Flight (TOF) scheme.

In another embodiment, the 3D sensor 135 may include two or more cameras and may be implemented in a stereo vision scheme in which 3D coordinate information is generated by combining two or more images acquired from the two or more cameras.

The sensing unit 20 may include a tilt information acquisition unit (not shown) for acquiring tilt information of the floor H in relation to the body 30. For example, the tilt information acquisition unit may include a gyro sensor 26. The tilt information acquisition unit may include a processing module (not shown) that converts a sensing signal of the gyro sensor 26 into the tilt information. The processing module may be implemented to be an algorithm or a program as part of the controller 10. In another example, the tilt information acquisition unit may include a magnetic field sensor 127 to acquire the tilt information based on sensing information about a magnetic field of the earth.

Herein, the floor indicates the horizontal plane, which indicates a plane perpendicular to a gravity direction. The gyro sensor 26 may acquire information about a rotational angular speed relative to the horizontal plane of the body 30. Specifically, the gyro sensor 26 may sense a rotation angular velocity about X and Y axes parallel to the horizontal plane and orthogonal to each other. A rotation velocity relative to the horizontal plane may be calculated by synthetizing a rotation angular velocity (roll) about X axis and a rotation angular velocity (pitch) about Y axis through the processing module. By integrating the rotation angular velocities through the processing module, a tilt value may be calculated.

The gyro sensor 26 may sense a preset reference direction. The tilt information acquisition unit may acquire the tilt information based on the reference direction.

The gyro sensor 26 may have a gyro sensing function with respect to three axes orthogonal to one another in a space coordinate system. Information collected by the gyro sensor 26 may be roll, pitch, and yaw information. The processing module is able to calculate a heading angle of the cleaner 1 or 1' by integrating rolling, pitching, and yaw angular velocities.

It is desirable that the gyro sensor 26 is disposed at the body 30. Accordingly, the gyro sensor 26 is disposed at other parts Q belonging to the body 30, which will be described later. In addition, the tilt information acquisition unit is disposed at other parts Q.

The gyro sensor 26 may be implemented as an additional sensor or as some functions of an IMU sensor which will be described later.

The sensing unit 20 may include a magnetic field sensor 27 that senses a magnetic field. The magnetic field sensor 27 may have a function of sensing a magnetic field with respect to three axes orthogonal to one another in a space coordinate system. The magnetic field sensor 27 may measure a heading angle (an azimuth angle). The magnetic field sensor 27 may be implemented as an additional sensor or as some functions of an IMU sensor which will be described later.

The sensing unit 20 may include an accelerometer 28 that senses acceleration of the cleaner 1 or 1'. The accelerometer 28 may have a function of sensing acceleration with respect to three axes orthogonal to one another in a space coordinate system. The acceleration sensor 28 may be implemented as an additional sensor or as some functions of an IMU sensor which will be described later.

The cleaner 1 may include an Inertial Sensor Unit (IMU) (not shown). Based on information of the IMU, the cleaner 1 may stabilize a traveling motion. The IMU 26 may have a function of the gyro sensor 26, a function of the magnetic field sensor 27, and a function of the accelerometer 28.

The sensing unit 20 may include a load information acquisition unit 29 that acquires load information of the mop motor 61.

In one example, the load information acquisition unit 29 may senses the load of the mop motor 61 by sensing a motor load current value or motor load voltage value of the mop motor 61. Specifically, the load information acquisition unit 29 may be implemented by a current detection unit provided in the mop motor controller 11.

In another example, the load information acquisition unit 29 may be provided using an encoder that senses a rotation speed or the number of rotation of the mop unit 41. Specifically, as the load applied to the mop 411 is increased, the rotation speed may be slowed down compared to a rotation signal (a current value, a voltage value, or the like) applied to the mop motor 61. The load information may be acquired as information about the rotation speed is sensed by the encoder.

The sensing unit 20 may include a collision sensor (not shown) that senses contact with an external object. The collision sensor may be implemented by a bumper (not shown) that is pressed by the external object.

The sensing unit 20 may include an encoder (not shown) that recognizes a path along which the cleaner 1 or 1' is actually moving. The function of the encoder may be performed by an auxiliary wheel 58.

The cleaner 1 or 1' include an input unit 16 through which various commands from a user can be input. The input unit 16 may include a button, a dial, a touch-type display, etc. The input unit 16 may include a microphone (not shown) for voice recognition. The input unit 16 may include a power switch 16*a* for inputting On/Off of power supply.

The cleaner 1 or 1' may include an output unit 17 that outputs various kinds of information to a user. The output unit 17 may include a display (not shown) that outputs visual information. The output unit 17 may include a speaker (not shown) that outputs audible information.

The cleaner 1 or 1' includes a storage unit 18 that stores various kinds of information. The storage unit 18 may include a volatile or no-volatile recording medium. The storage unit 18 may store an algorithm for controlling operation to respond to a variety of errors of the cleaner 1 or 1'.

A map about a traveling region may be stored in the storage unit 18. The map may be input by an external terminal capable of exchanging information through a communication unit 19, or may be generated as the cleaner 1 or 1' learns the same by itself. In the former case, the external terminal may be, for example, a remote controller, a PDA, a laptop, a smart phone, and a tablet in which an application for setting a map is installed.

The cleaner 1 or 1' may include the communication unit 19 capable of accessing a specific network. According to a communication standard, the communication unit 19 may be implemented using a wireless communication technology, such as IEEE 802.11 WLAN, IEEE 802.15 WPAN, UWB, Wi-Fi, Zigbee, Z-wave, Blue-Tooth, etc.

The cleaner 1 includes a controller 10 that controls autonomous traveling. The controller 10 may be implemented by a PCB Co disposed inside the body 30.

The controller 10 may process a signal from the input unit 16 or a signal input through the communication unit 19.

The controller 10 may control traveling of the cleaner by receiving a sensing signal of the sensor 20.

The controller 10 may control a water supply module 80. The controller 10 may control a bump 85 to adjust an amount of water to be supplied. Due to the control of the bump 85, an amount of water to be supplied to the mop module 40 per hour may be changed. In another example, the controller 10 may control a value, which will be described later, to change whether or not to supply water.

The controller 10 may learn a travel region through an image sensed by the camera 24, and control the current location to be recognizable. The controller 10 may be provided to map the travel region through the image. The controller 10 may be provided to allow the current location to be recognizable on a mapped map through the image. An image captured by the camera 24 may be used to generate a map of the travel region and detect the current location within the travel region. For example, the controller 10 may generate a map of the travel region using a boundary between the ceiling and a sidewall in an image of an area above the cleaner 1 or 1', the image which is captured by the camera. In addition, the controller 10 may sense the current location within the travel region based on features in the image.

The controller 10 may control the cleaner 1 or 1' to return back to a charging station after completion of traveling.

In one example, the cleaner 1 or 1' may be provided to return back to a charging station by sensing an Infrared (IR) signal transmitted by the charging station. The controller 10 may control the cleaner 1 or 1' to return back to the charging station based on a sensed signal which is transmitted by the charging station. The charging station may include a signal transmitter (not shown) that transmits a specific return signal.

In another example, the controller 10 may control the cleaner 1 or 1' to return back to the charging station by recognizing the current location on a map. By recognizing a location corresponding to the charging station and the current location on the map, the cleaner 1 or 1' is able to return back to the charging station.

The controller 10 may control the cleaner 1 or 1' based on information input through a user's terminal (e.g., a smart phone, a computer, or the like). The cleaner 1 or 1' may receive the input information through the communication unit 19. Based on the input information, the controller 10 may control a traveling pattern (e.g., traveling in zig-zag fashion or traveling mainly a specific region for cleaning) of the cleaner 1 or 1'. Based on the input information, the controller 10 may control whether or not to activate a specific function (e.g., a function of searching for a missing thing or a function of rebelling an insect) of the cleaner 1 or 1'. Based on the input information, the controller 10 may set a cleaning travel start time of the cleaner 1 or 1' to a specific time (cleaning reservation function).

The controller 10 includes the mop motor controller 11 that controls driving of the mop motor 61. The controller 10 may include a first mop motor controller 11*a* that controls driving of a first mop motor 61*a*. The controller 10 may include a second mop motor controller 11*b* that controls driving of a second mop motor 61*b*.

The controller 10 of the cleaner 1 according to an embodiment A which will be described later may further include an auxiliary motor controller 12 that controls driving of an auxiliary motor 71 which will be described later.

Hereinafter, a cleaner 1 according to an embodiment A and a cleaner 1' according to an embodiment B will be described with reference to FIGS. 1A and 1B.

Referring to FIG. 1A, the cleaner 1 according to the embodiment A includes the body 30, the mop module 40, and an auxiliary module 50 supporting the body 30 against a floor H together with the mop module 40.

The auxiliary module 50 is provided to be in contact with the floor. The auxiliary module 50 may be provided to be in contact with the floor from a location spaced apart from the mop module 40 in a front-rear direction. The mop module 40 may be disposed behind the auxiliary module 50. The body 30 is supported by the mop module 40 and the auxiliary module 50. The body 30 is disposed to connect the mop module 40 and the auxiliary module 50.

In this embodiment, the auxiliary module 50 brushes the floor to collect foreign substances. In another example, the auxiliary module may be provided to perform a mopping task by sliding the floor according to movement of the body 30. In yet another example, the auxiliary module is provided to perform a mopping task using a mop that rotates separately from the mop module 40. In yet another example, the auxiliary module may not have an additional cleaning function be provided to enable vacuum cleaning. In yet another example, the auxiliary module may be provided to include a wheel and the like without an additional cleaning function to function as supporting the body 30 together with the mop module 40. The auxiliary module is required only to support the body 30 together with the mop module 40, so the whole configuration of the auxiliary module 50 may be variable.

Figure 1B:
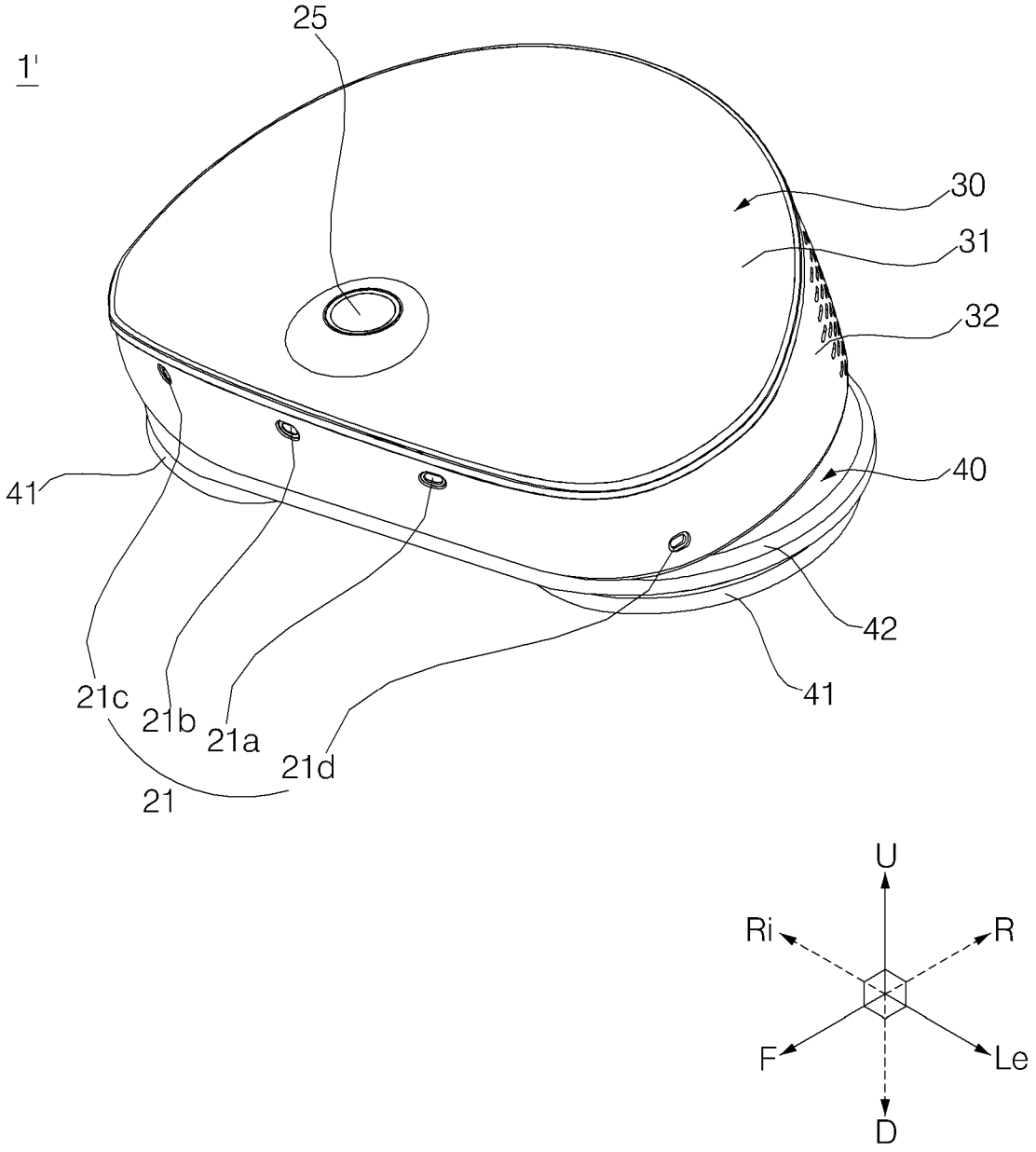
FIG. 1B is a perspective view of a cleaner 1' according to an embodiment B of the present invention.

Referring to FIG. 1B, the cleaner 1' according to the embodiment B is composed of the body 30 and the mop module 40. The cleaner 1' does not include the auxiliary module. The body 30 of the cleaner 1' is supported by the mop module 40 alone.

Hereinafter, a specific part P and other parts Q mentioned in the present invention will be described with reference to FIGS. 2A to 2D.

The specific part P and other parts Q respectively indicate one part and other parts in the configuration of the cleaner 1 or 1'.

To define the specific part P, at least three requirements (a first requirement, a second requirement, and a third requirement)as below need to be satisfied.

The first requirement is a requirement that "the specific Part includes the at least one mop 411." That is, the specific part may indicate the mop 411 alone or an assembly in which the mop 411 and another component are coupled to each other.

The second requirement is a requirement that "the specific part P is the whole or part of the mop module 40." That is, the specific part P may indicate the mop module 40 or may indicate part of the mop module 40.

The third requirement is a requirement that "the specific part P is detachable from other parts of the cleaner except for the specific part P."

Even as for a cleaner according to one embodiment, a plurality of different specific parts P satisfying the three requirements may be defined. For example, in a cleaner referring to FIGS. 2A to 2D, four specific parts P are defined (specifically, in a cleaner referring to FIGS. 2A and 2D, the mop module 40 is defined as one specific part P, the first mop 411*a* is defined as another specific part P, the second mop 411*b* is defined as another specific part P, and a pair of mops 411 is defined as another specific part P).

In some implementations, the specific part P may be defined as at least one of the following: at least one mop 411, at least one mop unit 41, and at least one mop module 40.

Figure 2A:
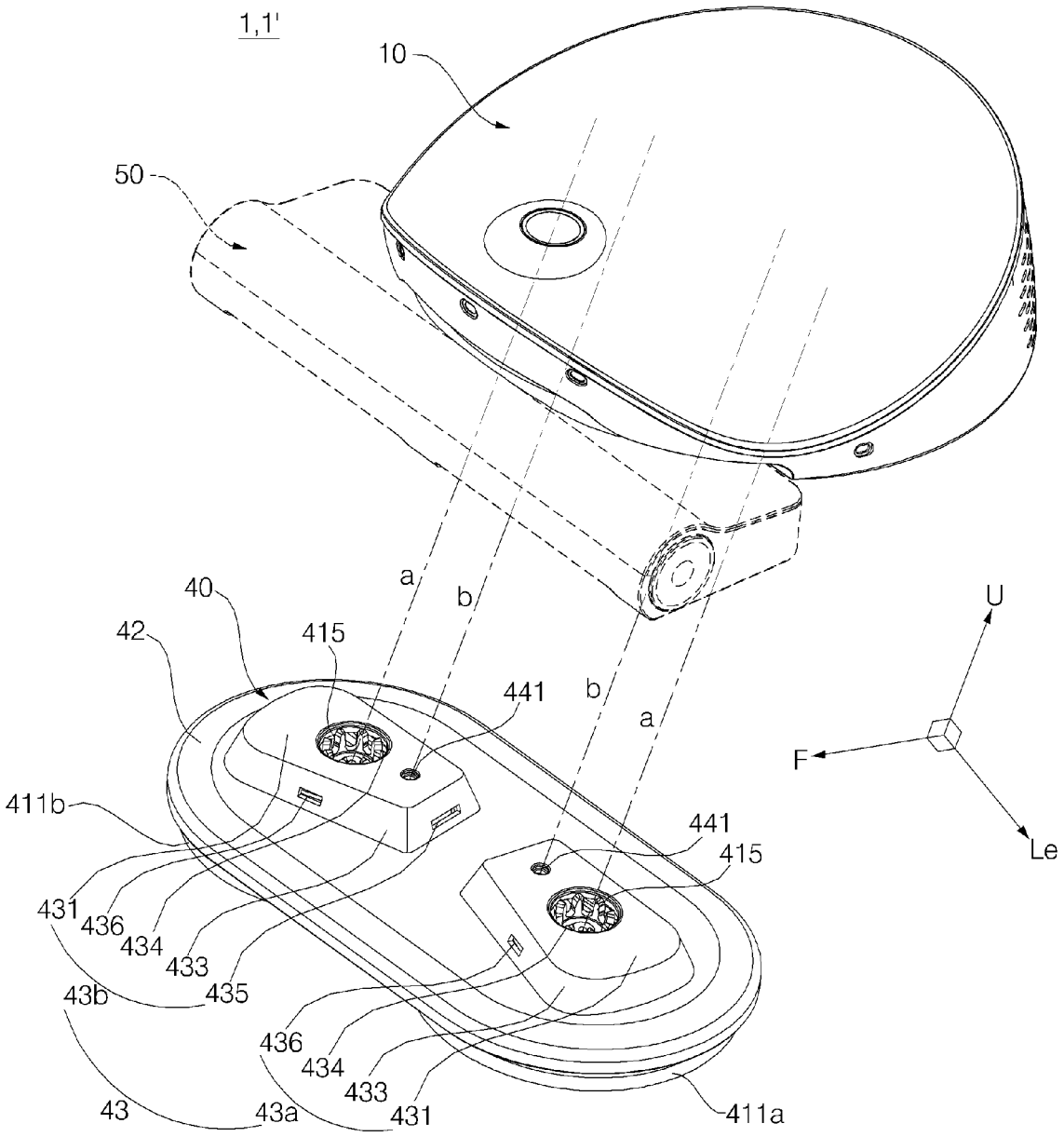
FIGS. 2A to 2D are perspective views showing detachment embodiments in which a detachable separate part P and other parts Q are implemented in the cleaner 1 or 1' of FIG. 1A or 1B. In each detachment embodiment according to FIGS. 2A to 2D, each of the embodiments A and B shows a table in which the specific part P and other parts Q are indicated.

In the cleaner 1 or 1' according to a first detachment embodiment with reference to FIG. 2A, the mop module 40 is provided detachable from the body 30. The mop module 40 may be provided to be integrally detachable from the body 30. The mop module 40 is formed to connect the plurality of mop units 41*a* and 41*b*.

Referring to a table in FIG. 2A, the specific part of the cleaner 1 is the mop module 40, and other parts Q include the body 30 and the auxiliary module 50.

Referring to the table in FIG. 2A, the specific part of the cleaner 1' is the mop module 40, and other parts Q includes the body 30.

Figure 2B:
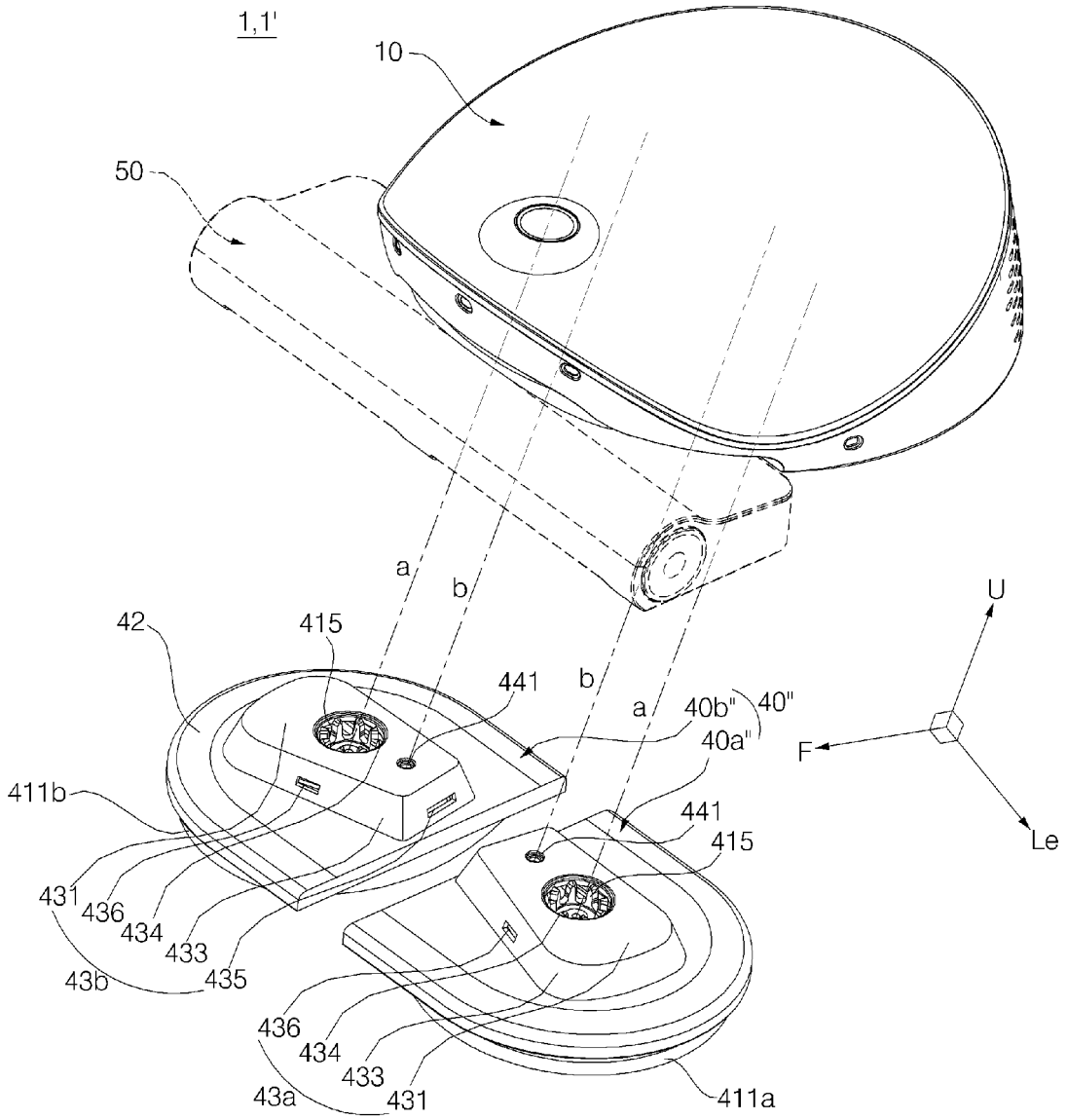

In the cleaner 1 or 1' according to a second detachment embodiment with reference to FIG. 2B, a mop module 40" includes a plurality of mop modules 40*a*" and 40*b*" separated from each other. The plurality of mop modules 40*a*" and 40*b*" may include a first mop module 40*a*" and a second mop module 40*b*" arranged in the left-right direction. Each of the plurality of mop modules 40*a*" and 40*b*" may be provided detachable from the body 30. The plurality of mop modules 40*a*" and 40*b*" includes a plurality of mops 411*a* and 411*b* respectively coupled thereto. That is, the first mop 411*a* is coupled to the first mop module 40*a*", and the second mop 411*b* is coupled to the second mop module 40*b*".

Referring to a table in FIG. 2B, three different specific parts P are defined in the cleaner 1 or 1'.

Referring to the table in FIG. 2B, in the case where the specific part P of the cleaner 1 is the first mop module 40*a*", other parts Q include the body 30, the auxiliary module 50, and the second mop module 40*b*". In the case where the specific part P is the second mop module 40*b*", other parts Q include the body 30, the auxiliary module 50, and the first mop module 40*a*". In the case where the specific part P is the plurality of mop modules 40", other parts Q include the body 30 and the auxiliary module 50.

Referring to FIG. 2B, in the case where the specific part P of the cleaner 1' is the first mop module 40*a*", other parts Q include the body 30 and the second mop module 40*b*". In the case where the specific part P is the second mop module 40*b*", other parts Q includes the body 30 and the first mop module 40*a*". In the case where the specific part P is the plurality of mop modules 40", other parts Q include the body 30.

Figure 2C:
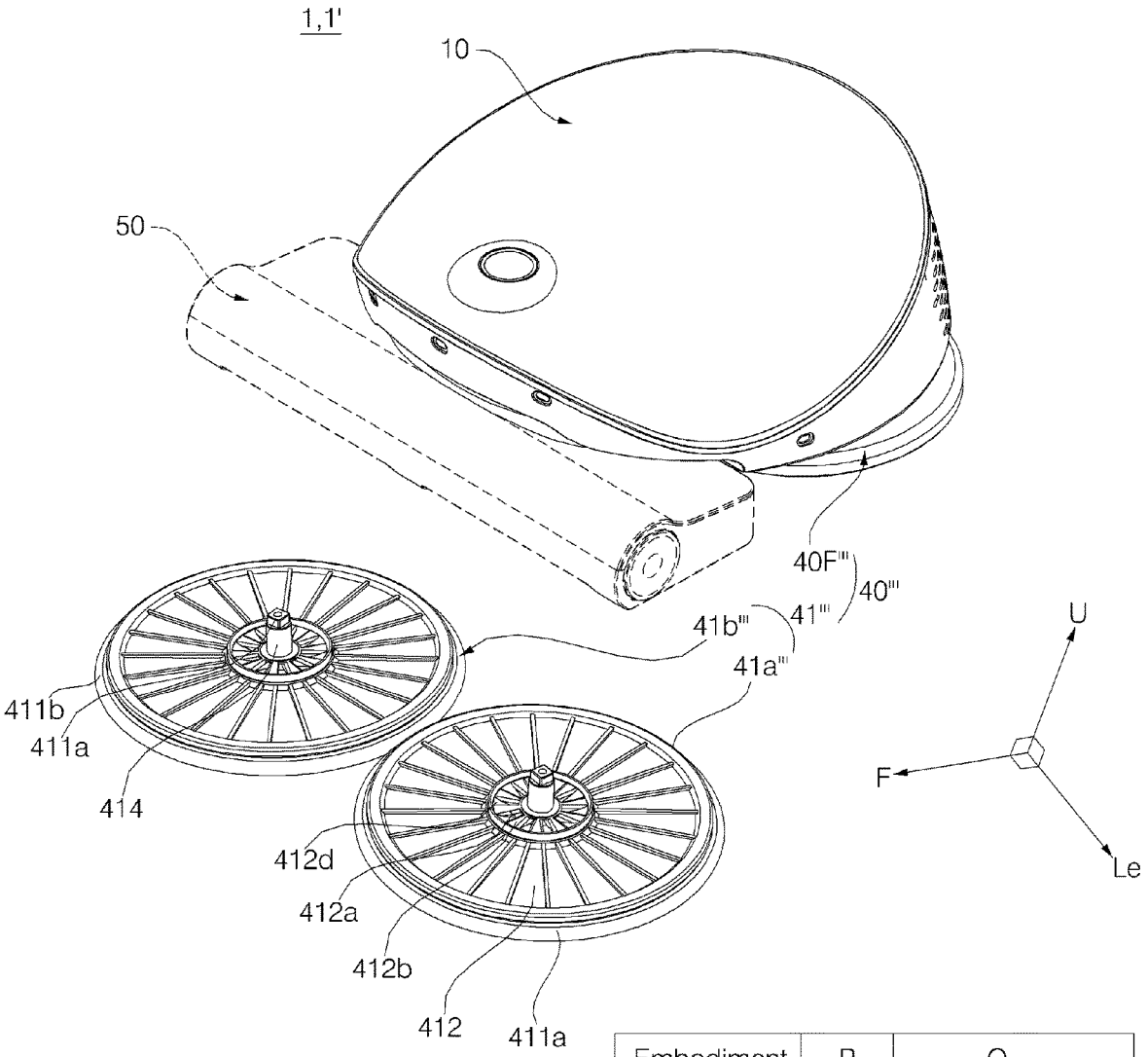

In the cleaner 1 or 1' according to a third detachment embodiment with reference to FIG. 2C, the mop module 40'"

includes at least one mop unit 41''' which is provided detachable. The at least one mop unit 41''' includes a plurality of mop units 41*a*''' and 41*b*'''. The plurality of mop units 41*a*''' and 41*b*''' may include a first mop unit 41*a*''' and a second mop unit 41*b*''' arranged in the left-right direction. The plurality of mop units 41*a*''' and 41*b*''' includes a plurality of mops 411*a* and 411*b* respectively coupled thereto. That is, the first mop 411*a* is coupled to the first mop unit 41*a*''', and the second mop 411*b* is coupled to the second mop unit 41*b*'''. The mop unit 41'' is detachably coupled to a part 40F''' of the mop module 40''' except for the mop unit 41'''.

Referring to a table in FIG. 2C, three different specific parts P are defined in the cleaner 1 or 1'.

Referring to FIG. 2C, in the case where the specific part P of the cleaner 1 is the first mop unit 41*a*''', other parts Q includes the body 30, the auxiliary module 50, the part 40F''', and the second mop unit 41*b*'''. In the case where the specific part P is the second mop unit 41*b*''', other parts Q includes the body 30, the auxiliary module 50, the part 40F''', and the first mop unit 41*a*'''. In the case where the specific part P is the plurality of mop units 41''', other parts Q include the body 30, the auxiliary module 50, and the part 40F'''.

Referring to FIG. 2C, the specific part P of the cleaner 1' is the first mop unit 41*a*''', other part Q includes the body 30, the part 40F''', and the second mop unit 41*b*'''. In the case where the specific part P is the second mop unit 41*b*''', other parts Q include the body 30, the part 40F''', and the first mop unit 41*a*'''. In the case where the specific part P is the plurality of mop units 41''', other parts Q includes the body 30 and the part 40F'''.

Figure 2D:
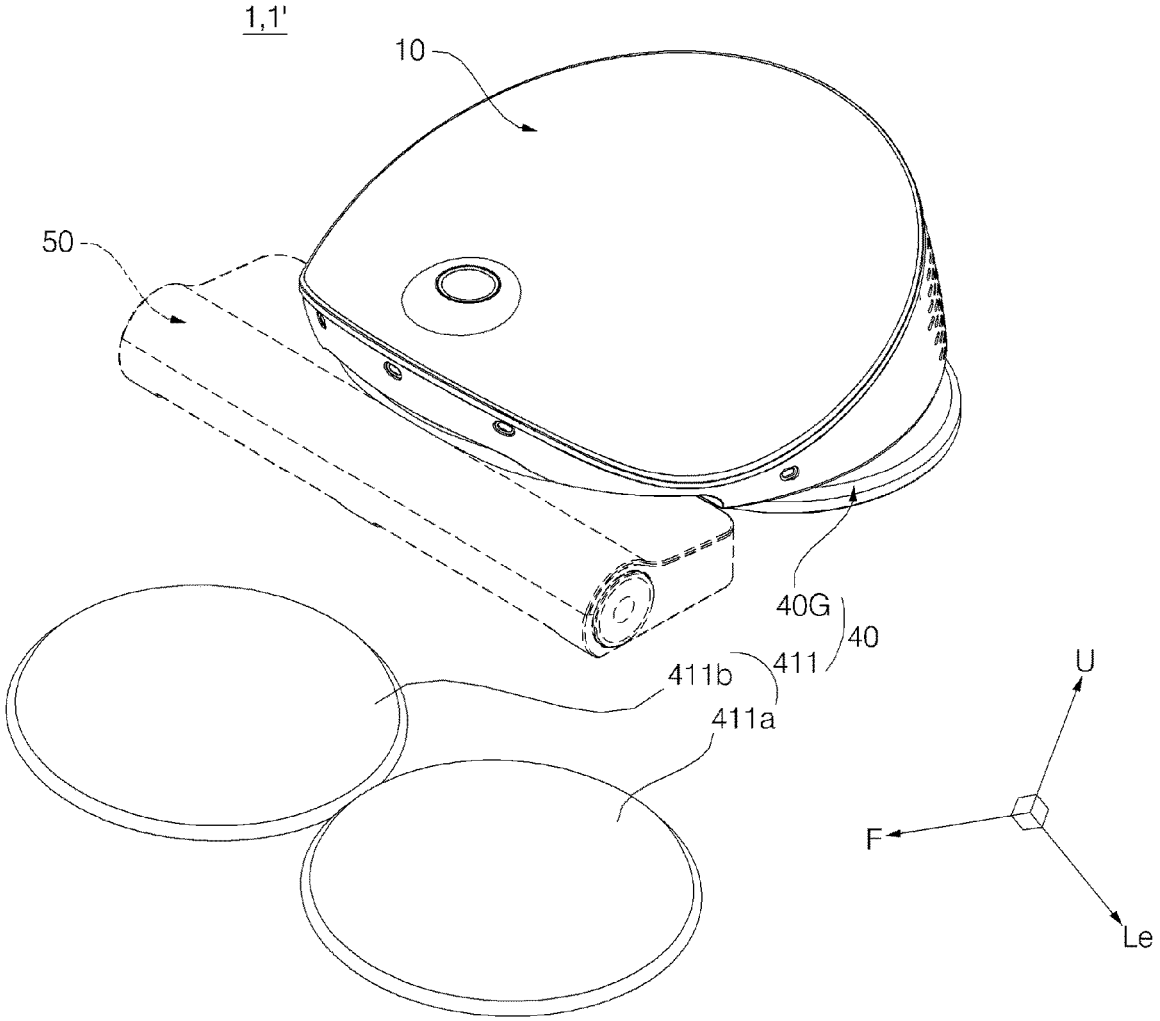

In the cleaner 1 or 1' according to a fourth detachment embodiment with reference to FIG. 2D, the mop module 40''' includes at least one mop 411 which is provided detachable. The at least one mop 411 includes the plurality of mops 411*a* and 411*b*. The plurality of mops 411*a* and 411*b* may include the first mop 411*a* and the second mop 411*b* arranged in the left-right direction. The mop 411 composes part of the mop unit 41. The mop 411 is detachably coupled to a part 40G of the mop module 40 except for the mop 411. The mop 411 is detachably coupled to a rotation plate 412.

Referring to FIG. 2D, in the case where the specific part P of the cleaner 1, other parts Q includes the body 30, the auxiliary module 50, the part 40G, and the second mop 411*b*. In the case where the specific part P is the second mop 411B, other parts Q includes the body 30, the auxiliary module 50, the part 40G, and the first mop 411*a*. In the case where the specific part P is the plurality of mops 11, other parts Q include the body 30, the auxiliary module 50, and the part 40G.

Referring to FIG. 2D, in the case where the specific part P of the cleaner 1' is the first mop 411*a*, other parts Q include the body 30, the part 40G, and the second mop 411*b*. In the case where the specific part P is the second mop 411*b*, other parts Q include the body 30, the part 40G, and the first mop 411*a*. In the case where the specific part is the plurality of mops 411, other parts include the body 30 and the part 40G.

In cells for other parts Q In the tables of FIGS. 2A to 2D, only reference numerals shown in FIGS. 2A to 2D are included, but the mop driving unit 60, the water supply module 80, a detachment module 90 and/or an auxiliary driving unit, which will be described later, may be further included. That is, other part Q further include any other component(s) disposed at the body 30.

Meanwhile, a state in which a specific part P and other parts Q are coupled to one another may be hereinafter referred to as a "coupled state." In addition, a state in which a specific part P and other parts Q are separated from one another may be hereinafter referred to as a "separated state."

Meanwhile, in order to determine whether a predetermined specific part P is detached or not based on the load information acquired using the load information acquisition unit 29, it is desirable that the mop motor 61 is disposed at other parts Q. In order to determine whether a specific part P according to the first and second detachment embodiments is detached based on the load information, the mop motor 61 is disposed at the body 30. In order to determine whether a specific part P according to the third detachment embodiment is detached based on the load information, the mop motor 61 is disposed at the body 30 or the part 40F''. In order to determine whether a specific part P according to the fourth detachment embodiment is detached based on the load information, the mop motor 61 is disposed at the body 30 or the part 40G.

Meanwhile, in order to determine whether a predetermined specific part P is detached based on the tilt information acquired using the tilt information acquisition unit, the body 30 of the cleaner 1 or 1' tilts in relation to the floor (the horizontal plane) H due to gravity while the specific part P and other parts Q are separated. With reference to FIGS. 3A to 3D, example situations in which the body 30 is inclined with the specific part P being separated will be described as below.

Figure 3A:
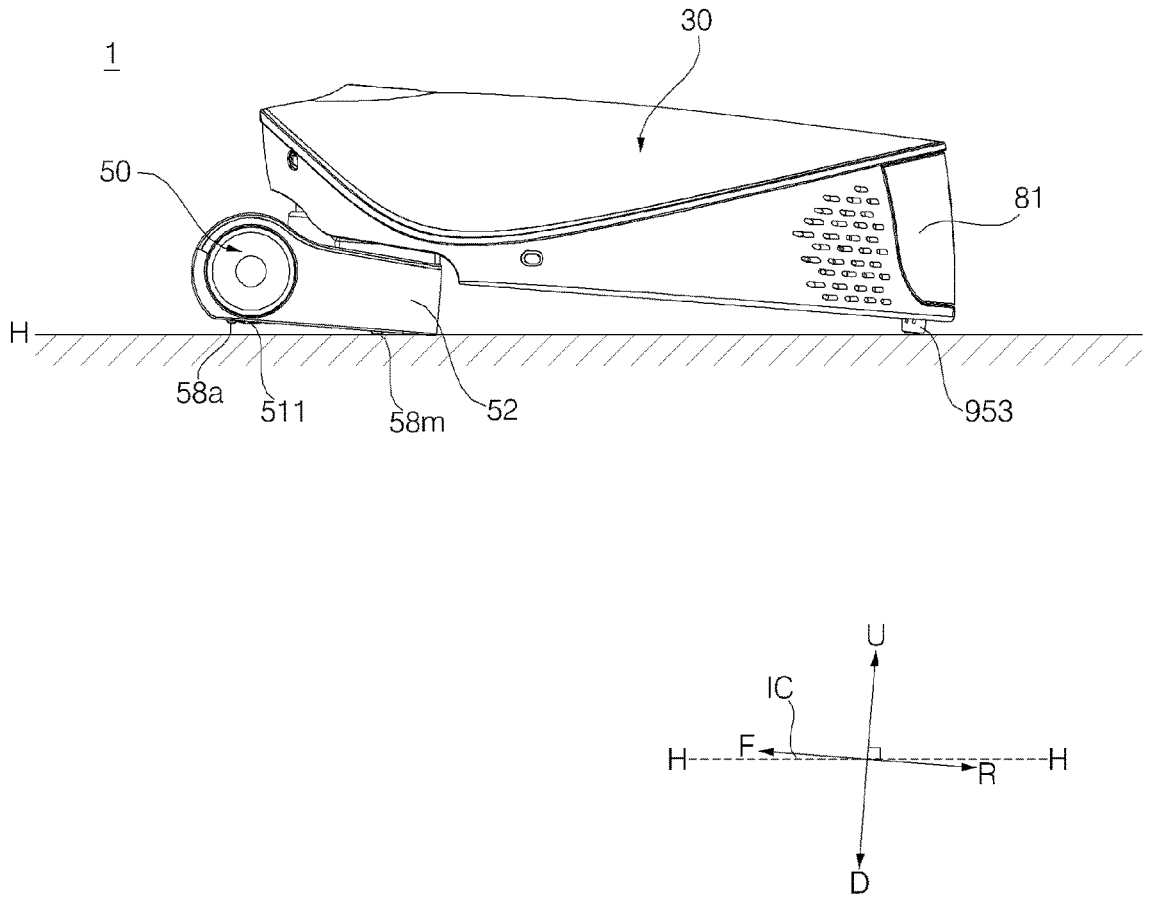
FIGS. 3A to 3D are elevation views showing the case where a selected specific part P is separated from other parts Q in any one of the detachment embodiments of FIGS. 2A to 2D, wherein other parts Q are placed on a floor H to cause tilting of a body 30.

A first exemplary situation referring to FIG. 3A is as below. While the mop module 40, which is a specific part P of the cleaner 1 according to the first detachment embodiment, is separated from other parts Q, the body 30 tilts in relation to the floor H due to gravity. In this case, the body 30 may form a downward incline in a direction opposite to a direction in which the auxiliary module 50 is disposed. That is, as only one side of the body 30 is lifted upward by the auxiliary module 50, tilting of the body 30 occurs in the separated state, compared to the coupled state.

Figure 3B:
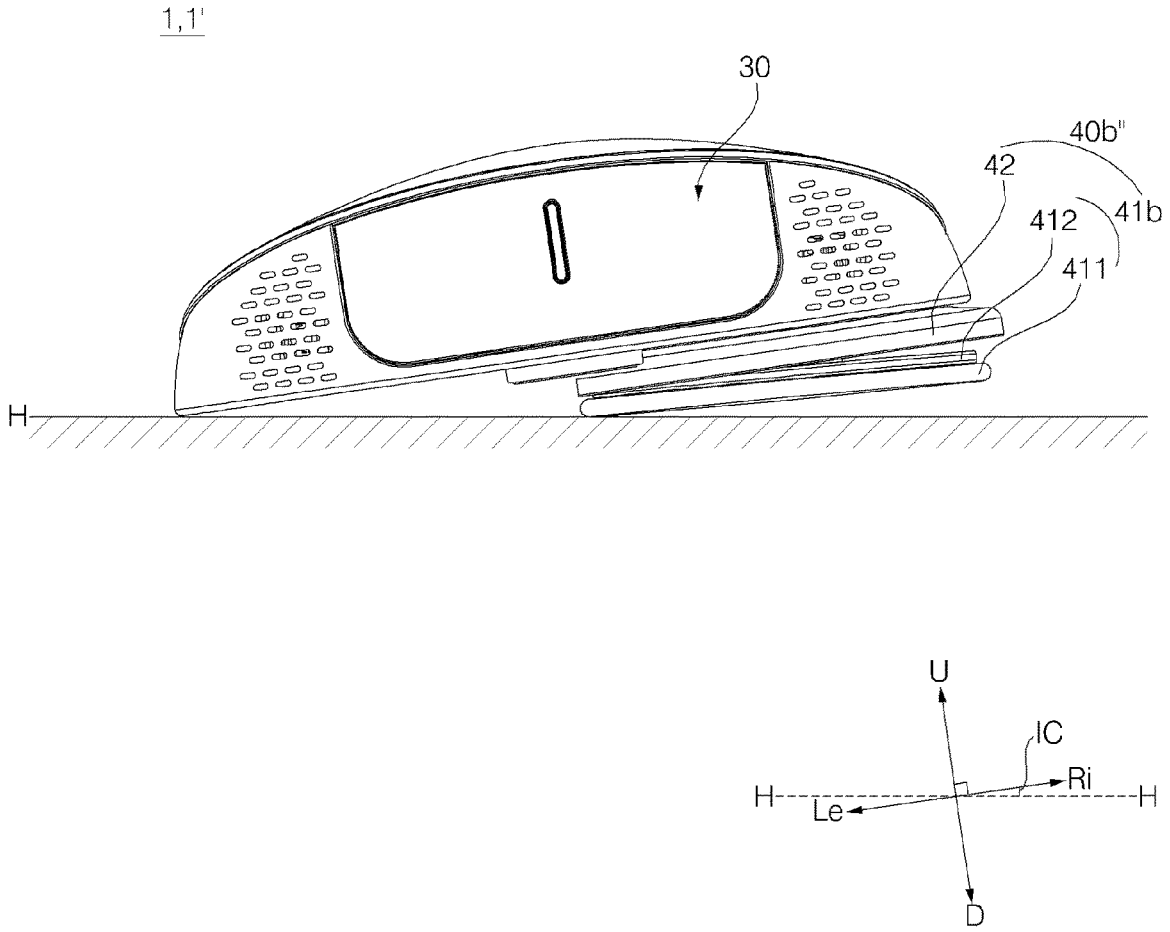

A second exemplary situation referring to FIG. 3B is as below. While the first mop module 40*a*'', which is a specific part P of the cleaner 1 or 1' according to the second detachment embodiment, is separated from other parts Q, the body 30 tilts in relation to the floor H due to gravity. In this case, the body 30 may form a downward incline in a direction opposite to a direction in which the second mop module 40*b*'' is disposed. That is, as only one side of the body 30 is lifted by the second mop module 40*b*'', tilting of the body 30 occurs in the separated state, compared to the coupled state.

In the case where at least one of the plurality of mop module 40*a*'' and 40*b*'' in the cleaner 1 according to the second detachment embodiment and the embodiment A is separated from other part Q, the body 30 may be tilted.

In the case where any one of the plurality of mop modules 40*a*'' and 40*b*'' in the cleaner 1' according to the second detachment embodiment and the embodiment B, the body 30 may be tilted.

Figure 3C:
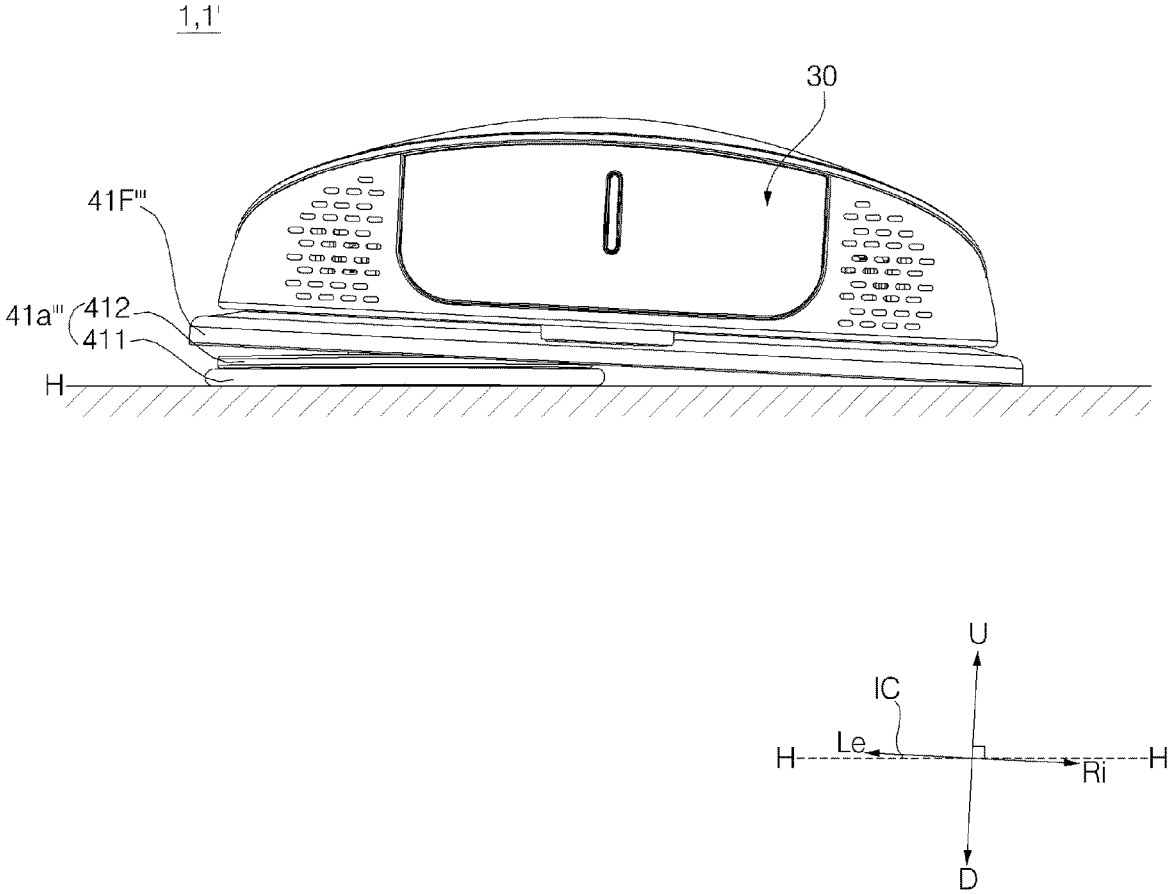

A third exemplary situation referring to FIG. 3C is as below. While the second mop unit 41*b*''', which is a specific part P of the cleaner 1 or 1' according to the third detachment embodiment, is separated from other parts Q, the body 30 tilts in relation to the floor H due to gravity. In this case, the body 30 may form a downward incline in a direction opposite to a direction in which the first mop unit 41*a*''' is disposed. That is, as only one side of the body 30 is lifted upward by the first mop unit 41*a*''', tilting of the body 30 occurs in the separated state, compared to the coupled state.

In the case where at least one of the plurality of mop units 41*a*''' and 41*b*''' in the cleaner 1 according to the third detachment embodiment and the embodiment A is separated from other parts Q, the body 30 may be tilted.

In the case where any one of the plurality of mop units 41*a*''' and 41*b*''' in the cleaner 1' according to the third detachment embodiment and the embodiment B is separated from other parts Q, the body 30 may tilts.

Figure 3D:
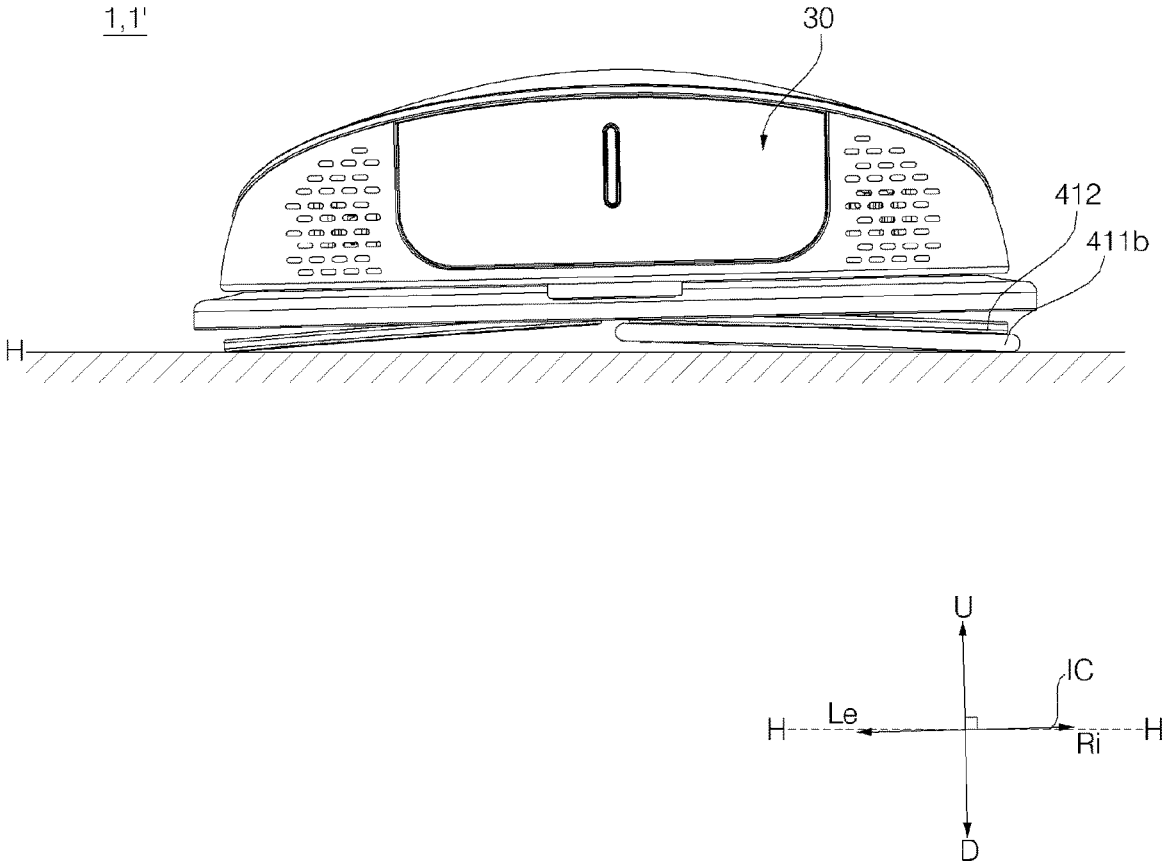

A fourth exemplary situation referring to FIG. 3D is as below. While the first mop 411*a*, which is the specific part P of the cleaner 1 or 1' according to the fourth detachment embodiment, is separated from other parts, the body 30 tilts in relation to the floor H due to gravity. In this case, the body 30 may form a downward incline in a direction opposite to a direction in which the second mop 411*b* is disposed. That is, as only one side of the body 30 is lifted by the second mop 411*b*, tilting of the body 30 occurs in the separated state, compared to the coupled state.

In the case where at least one of the plurality of mops 411*a* and 411*b* in the cleaner 1 according to the fourth detachment embodiment and the embodiment A is separated from other parts Q, the body 30 may tilts.

In the case where any one of the plurality of mops 411*a* and 411*b* in the cleaner 1' according to the fourth detachment embodiment and the embodiment B is separated from other parts Q, the body 30 may tilt.

The controller 10 may control the cleaner 1 or 1' based on tilt information acquired using the tilt information acquisition unit. The controller 10 may control the cleaner 1 or 1' based on tilt information which is acquired by processing a sensing signal of the gyro sensor 26.

The tilt information may include information about a tilt value. The tilt value may be preset as a value that is relevant to a degree of tilting against a horizontal floor H. When the tilt value falls into a specific angle range (e.g., an angle of between 3 to 5 degrees) depending on a structure of the cleaner, the controller 10 may recognize a specific part P as being separated.

When a plurality of different specific parts is defined in any cleaner 1 or 1', a calculated tilt value may vary according to which part among the plurality of specific parts P is separated.

For example, with reference to FIGS. 3A to 3D, a tilt value IC in the third exemplary situation is smaller than tilt values IC in the first and second exemplary situations, and a tilt value IC in the fourth exemplary situation is smaller than tilt values IC in the first to third exemplary situations.

The tilt information may include information about a tilt direction. The tilt direction indicates a downward tilt direction.

In the case where a plurality of different specific parts P is defined in any cleaner 1 or 1', a calculated tilt direction may vary depending on which part among the plurality of specific parts P is separated.

For example, with reference to FIGS. 3A to 3D, a tilt direction in the first exemplary situation is a rearward direction. In addition, tilt directions in the second and fourth situations is a leftward direction in the case of the cleaner 1' and a left-rearward direction in the case of the cleaner 1. In addition, a tilt direction in the third exemplary situation is a rightward direction in the case of the cleaner 1' and a right-rearward direction in the case of the cleaner 1.

Based on the tilt value and the tilt direction, the controller 10 may recognize which specific part P is separated among a plurality of specific parts P of any one cleaner 1 or 1'. Depending on which specific part P is separated, the controller 10 may perform a control action to perform a mop separation error response operation in a different way. For example, a name, a symbol, a picture, voice or the like corresponding to a separated specific part P may be output.

In the first exemplary situation of FIG. 3A, the tilt information acquisition unit may acquire tilt information about a tilt value IC and a tilt direction (rearward), and accordingly, the controller 10 may recognize the mop module 40, which is the specific part P, as being separated.

In the second exemplary situation of FIG. 3B, the tilt information acquisition unit may acquire tilt information about a tilt value IC and a tilt direction (leftward or left-rearward), and accordingly, the controller 10 may recognize the first mop module 40*a*'', which is the specific part P, as being separated.

In the third exemplary situation of FIG. 3C, the tilt information acquisition unit may acquire tilt information about a tilt value IC and a tilt direction (rightward or right-rearward), and accordingly, the controller 10 may recognize the second mop unit 41*b*''', which is the specific part P, as being separated.

In the fourth exemplary situation of FIG. 3D, the tilt information acquisition unit may acquire tilt information about a tilt value IC and a tilt direction (leftward or left-rearward), and accordingly, the controller 10 may recognize the first mop 411*a*, which is the specific part P, as being separated.

The controller 10 may control the controller 1 or 1' based on load information acquired using the load information acquisition unit 29.

The load information may include information about a load value that is proportional to a torque applied to the mop motor 61. When the mop 411 is rotating, the load value applied to the mop motor 61 is changed according to a friction force which the floor applies to the mop.

For example, when the mop motor 61, which is provided to rotate a mob 411 belonging to a specific part P being separated, is idling, a relatively low toque is applied to the mop motor 61. When the load information is equal to or smaller than a predetermined level, the controller 10 may recognize the specific part P as being separated.

For example, when the mop 411 is unable to rotate or is rotating smoothly as being obstructed by an external obstacle, a relatively high toque is applied to the mop motor 61 so as to rotate an obstructed mop 411. When the load information is equal to or greater than a predetermined level, the controller 10 may recognize the mop 411 as being obstructed by an external obstacle.

The load information acquisition unit 29 may acquire load information of each of the plurality of mop motors 61*a* and 61*b*. Specifically, the load information acquisition unit 29 may acquire load information of the first mop motor 61*a* and load information of the second mop motor 61*b*. In one example, the load information acquisition unit 29 may acquire load information of each of the plurality of mop motors 61*a* and 61*b*, by using a current detection unit provided in each of the plurality of mop motor controllers 11*a* and 11*b*. In another example, the load information acquisition unit 29 may acquire load information on each of the plurality of mop motors 61*a* and 51*b*, by using a plurality of encoders which detects a rotational speed or the number of rotation of each of the plurality of mop units 41.

Based on the load information of each of the plurality of mop motors 61*a* and 61*b*, the controller 10 may recognize which specific part P including which mop is separated among the plurality of mops 411*a* and 411*b*. In addition, based on load information of each of the plurality of mop motors 61*a* and 61*b*, the controller 10 may recognize which mop is obstructed among the plurality of mops 411*a* and 411*b*.

In the first exemplary situation of FIG. 3A, the load information acquisition unit 29 may acquire load information about a load value (equal to or smaller than a predetermined level) of the first mop motor 61*a* and load information (equal to or smaller than the predetermined level) of the second mop motor 61*b*, and accordingly, the controller 10 may recognize a specific part P, which including both the first mop 411*a* and the second mop 411*b*, as being separated.

In the second and fourth exemplary situations of FIGS. 3B and 3D, the load information acquisition unit 29 may acquire load information about a load value (equal to or smaller than a predetermined level) of the first mop motor 61*a* and a load value (a normal level) of the second motor 61*b*, and accordingly, the controller 10 may recognize a specific part P, which includes only the first mop 411*a*, as being separated.

In the third exemplary situation of FIG. 3C, the load information acquisition unit 29 may acquire load information about a load value (a normal level) of the first mop motor 61*a* and a load value (equal to or smaller than a predetermined level) of the second mop motor 61*b*, and accordingly, the controller 10 may recognize a specific part P, which includes only the second mop 411, as being separated.

Hereinafter, there are described conditions, of which satisfaction or unsatisfaction is determined in order to recognize whether a specific part P is separated and/or whether the mop 411 is obstructed.

Regarding linguistic/mathematical comparison in the description of those conditions, "equal to or smaller than" and "smaller than" are used interchangeable, and "equal to or greater" and "greater than" are used interchangeable.

The controller 10 may determine satisfaction or unsatisfaction of a specific tilt condition. The tilt condition is preset such that satisfaction or unsatisfaction thereof is to be determined by comparing a tilt value corresponding to the tilt information with a predetermined reference tilt value.

In one example, the tilt condition may be preset to be satisfied when the tilt value is greater than the reference tilt value (the lower limit tilt value).

In another example, the tilt condition may be preset to be satisfied when the tilt value is greater than a predetermined lower limit reference tilt value and smaller than a predetermined upper limit reference tilt value. The lower limit reference tilt value is preset to be a value smaller than the upper limit reference tilt value.

The controller 10 may determine satisfaction or unsatisfaction of a specific low load condition. The low load condition may be preset to be satisfied when a load value corresponding to the load information is relatively low, and not to be satisfied when the load value is relatively high. It may be preset to compare the load value with a predetermined low load reference value so as to determine satisfaction or unsatisfaction of the low load condition. For example, the low load condition may be preset to be satisfied when the load value is smaller than the low load reference value.

The controller 10 determines satisfaction or unsatisfaction of a specific high load condition. The high load condition is preset to be satisfied when a load value corresponding to the load information is relatively high, and to be not satisfied when the load value is relatively low. It may be preset to compare the load value with a predetermined high load reference value so as to determine satisfaction or dissatisfaction of the high load condition. For example, the high load condition may be preset to be satisfied when the load value is greater than the high load reference value.

The low load condition and the high load condition are is preset not to be satisfied at the same time. That is, in the case of determining satisfaction and unsatisfaction of the low load condition and the high load condition based on a certain load value, the low load condition and the high load condition are preset such that i)only the low load condition is allowed to be satisfied, ii) only the high load condition is allowed to be satisfied, or iii) both the low load condition and the high load condition are not allowed to be satisfied. To this end, the low load reference value may be preset to be smaller than the high load reference value.

Based on at least one of the tilt information and the load information, the controller 10 may determine satisfaction or unsatisfaction of a predetermined detachments condition which is preset to be satisfied when the specific part is separated from other pars. If the detachments condition is satisfied, the controller 10 controls the cleaner to perform a predetermined mop separation error response operation.

In the case where the specific part is the mop module 40, the detachments condition is preset to be satisfied while the mop module 40 is separated from the body 30.

Based on at least the tilt information, the controller 10 may determine satisfaction or unsatisfaction of the detachments condition. As described above, using tilt information that is changed when a specific part P is separated from other parts Q, the detachments condition may be preset. When it is determined, based on at least the tilt information, that the specific part P is separated from other parts Q, the controller 10 controls the cleaner to perform a predetermined mop separation error response operation.

Based on at least the load information, the controller 10 may determine satisfaction or unsatisfaction of the detachments condition. As described above, using load information that is changed when a specific part P is separated from other parts Q, the detachments condition may be preset. When it is determined, based on at least the load information, the specific part P is separated from other parts Q, the controller 10 controls the cleaner to perform a predetermined mop separation error response operation.

The detachments condition according to one embodiment is as below. The detachments condition includes the tilt condition. In this case, the detachments condition does not include the low load condition. That is, to make the detachments condition satisfied, satisfying the tilt condition is essential but satisfying the low load condition is irrelevant. For example, the detachments condition may be the tilt condition, and, in this case, when the tilt condition is satisfied, the detachments condition is satisfied.

The detachments condition according to another embodiment is as below. The detachments condition includes the low load condition. In this case, the detachments condition does not include the tilt condition. That is, to make the detachments condition according to another embodiment satisfied, satisfying the low load condition is essential but satisfying the tilt condition is irrelevant. For example, the detachments condition may be the low load condition, and, in this case, when the low load condition is satisfied, the detachments condition is satisfied.

The detachments condition according to yet another embodiment is as below. The detachments condition includes the tilt condition and the low load condition. The detachments condition is preset to be satisfied when at least both the tilt condition and the low condition are satisfied. That is, in order for the detachments condition according to yet another embodiment, it is essential to satisfy the low load condition and the tilt condition. For example, the detachments condition may be a condition in which both the low load condition and the tilt condition are satisfied.

Based on at least one of the tilt information and the load information, the controller 10 determines satisfaction or unsatisfaction of a predetermined obstructed condition that is preset to be satisfied when the mop 411 is obstructed by an external obstacle. When the obstructed condition is satisfied, the controller 10 controls the cleaner to perform a predetermined mop obstruction error response operation.

Based on at least the tilt information, the controller 10 determines satisfaction or unsatisfaction of a predetermined obstructed condition that is preset to be satisfied when the mop 411 is obstructed by an external obstacle. In the case where the mop 411 is obstructed by an external obstacle, the mop 411 may be lifted by the obstacle and thus tilt information of the cleaner may be changed. Using tilt information that is changed in response to obstruction by an obstacle, the obstructed condition may be preset.

Based on at least the load information, the controller 10 determines satisfaction or unsatisfaction of a predetermined obstructed condition that is preset to be satisfied when the mop 411 is obstructed by an external obstacle. As described above, when the mop 411 is obstructed by the external obstacle, a relatively high load (torque) is applied to the mop motor 61, and therefore, the obstructed condition may be preset using the relatively high load (torque).

The obstructed condition according to one embodiment is as below. In this case, the obstructed condition does not include the tilt condition. That is, to make the obstructed condition satisfied, satisfying the high load condition is essential but satisfying the tilt condition is irrelevant. For example, the detachments condition may be the high load condition, and, in this case, when the high load condition is satisfied, the detachments condition is satisfied.

The obstructed condition according to another embodiment is as below. The obstructed condition includes the high load condition and the tilt condition. The obstructed condition is preset to be satisfied when at least both the tilt condition and the high load condition are satisfied. That is, to make the obstructed condition according to another embodiment satisfied, satisfying the high load condition and the tilt condition is essential. For example, the obstructed condition may be a condition in which both the high load condition and the tilt condition are satisfied.

Meanwhile, each of the detachments condition and the obstructed condition may include the tilt condition, and the detachments condition and the obstructed condition may be preset differently. For example, the detachments condition may be preset to be satisfied when the tilt condition alone is satisfied, and the obstructed condition may be preset to be satisfied when both the tilt condition and the high load condition are satisfied.

Meanwhile, a predetermined error response operations is preset, which is an operation to be performed by the controller 10 when any one of a plurality of preset errors is determined. A plurality of error response operations corresponding to a plurality of errors may be preset. The plurality of error response operations may include the mop separation error response operation and the mop obstruction error response operation. The plurality of error response operations may include other error response operations.

An error response operation may include an operation of outputting visual information such as a message or a drawing/symbol. An error response operation may include an operation of outputting predetermined sound. An error response operation may include an operation of stopping traveling until an error is resolved. One error response operation may be configured as a combination of at least one of the aforementioned operations.

The mop separation error response operation may include an operation of outputting, to a user, information related to separation of a specific part P from other parts Q. The mop separation error response operation may include an operation of not traveling until the specific part P is coupled to other parts Q.

The mop obstruction error response operation is different from the mop separation error response operation. Specifically, the mop obstruction error response operation may include an operation of outputting, to the user, information related to locking of the mop 411. The mop obstruction error response operation may include a predetermined operation for resolving the obstruction of the mop 411. The mop obstruction error response operation may include an operation of not traveling properly until resolved obstruction of the mop 411 is recognized.

Other error response operations are different from the mop separation error operation and the mop obstruction error response operation. For example, when the tilt condition is satisfied and the high load condition and the low load condition are not satisfied, the controller 10 may control the error response operation to be performed.

Normal travel indicates performing a preset operation other than the error response operation.

Meanwhile, the detachments condition may be preset differently according to a detection time. In addition, the obstructed condition may be preset differently according to a detection time. In addition, whether to determine satisfaction or unsatisfaction of the obstructed condition may be changed according to a detection time.

Following are examples in which, before start to traveling, satisfaction or unsatisfaction of the detachments condition is determined in response to a travel start command for cleaning of the cleaner. For example, if the tilt condition alone is satisfied before traveling, the controller 10 may recognize a specific part P as being separated. In another example, if the tilt condition is satisfied and then the low load condition is satisfied before traveling, the controller 10 may recognize a specific part P as being satisfied.

When the tilt condition is satisfied during traveling of the cleaner, determination as to whether a specific part P is separated (determination as to whether a detachments condition is satisfied) may be reversed by a predetermined standard.

When the tilt condition is changed from an unsatisfied to a satisfied state during traveling of the cleaner, the controller 10 may control the cleaner to perform a predetermined avoidance operation. In doing so, in the case where tilting of the cleaner occurs by an external obstacle rather than separation of a specific part P, it is possible to avoid the obstacle and prevent the mop separation error operation which is irrelevant to an actual error.

The controller 10 may reserve determination as to satisfaction or unsatisfaction of the detachments condition until the avoidance operation is terminated by a predetermined standard. When the avoidance operation is terminated by the predetermined standard, the controller 10 may determine satisfaction or unsatisfaction of the detachments condition.

For example, the avoidance operation may include repeated rotation of the cleaner to the left and right. For example, the avoidance operation may include moving backward. For example, the avoidance operation may include rotating the mop 411 at an RPM faster than an RPM in a normal traveling situation.

The predetermined standard for terminating the avoidance operation may be preset as a condition for terminating an avoidance operation. The condition for terminating an avoidance operation may include a first condition in which a time period or the number of times of avoiding an obstacle exceeds a predetermined time period or a predetermined number. The condition for terminating an avoidance operation may include a second condition in which the controller 10 recognizes that avoiding an obstacle is successfully done. The condition for terminating an avoidance operation is preset to be satisfied when even one of the first condition and the second condition is satisfied.

The condition, which is required to be satisfied so as to perform the avoidance operation, and a detachments condition, of which satisfaction or unsatisfaction is determined after termination of the avoidance operation, may be preset differently. When the tilt condition is satisfied before the avoidance operation, the controller 10 may control the avoidance operation to be performed. When both the tilt condition and the low load condition are satisfied after termination of the avoidance operation by a predetermined standard, the controller 10 may control the mop separation error response operation to be performed. When the tilt condition and the high load condition are satisfied after termination of the avoidance operation by a predetermined standard, the controller 10 may control the mop obstruction error operation to be performed. When the tilt condition is satisfied and the high load condition and the low load condition are not satisfied after termination of the avoidance operation by a predetermined standard, the controller 10 may control other error response operations to be performed.

Meanwhile, the controller 10 may be preset not to determine satisfaction or unsatisfaction of the obstructed condition before the traveling of the cleaner, and may be preset to determine satisfaction or unsatisfaction of the obstructed condition during the travelling of the cleaner.

Hereinafter, methods for controlling the cleaner 1 or 1' according to first to seventh embodiments will be described with reference to FIGS. 13 to 19. Identical items in each flowchart will be indicated by the same reference numerals, and redundant descriptions will be omitted.

A control method may be implemented the controller 10. The present invention may be a method for controlling the cleaner 1 or 1' may be the cleaner 1 or 1' including the controller 10 which implements the method. The present invention may be a computer program including each step of the method or may be a recording medium which records a program for implementing the method by a computer. The "recording medium" indicates a computer readable recording medium. The present invention may be a cleaner control system including both hardware and software aspects.

Each step in a flowchart of the method, and a combination of flowcharts may be implemented by computer program instructions. The instructions may be included in a common computer or a specialized computer, and the instructions generates means for performing functions described in a step(s) of each flowchart.

In addition, in some alternative embodiments, it should be noted that the functions that are described in the blocks or steps may occur out of the order. For example, two successive steps may be performed substantially at the same time, or, sometimes, may be performed in a reverse order depending upon the functions.

Figure 13:
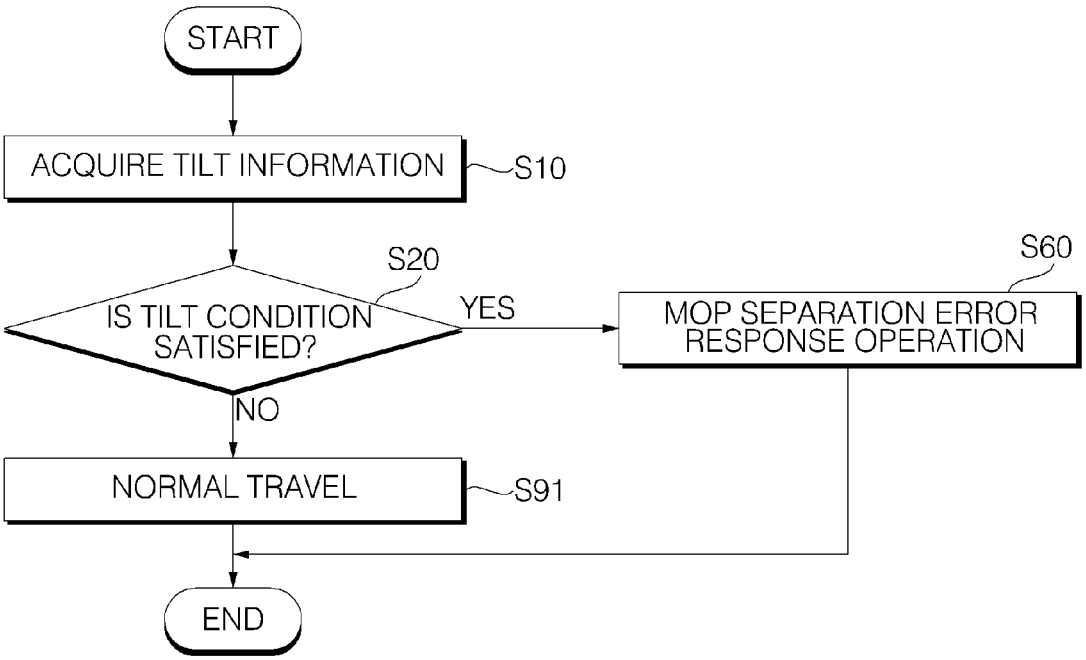
FIG. 13 is a flowchart illustrating a control method of the cleaner 1 or 1' according to a first embodiment of the present invention.

Referring to FIG. 13, a control method according to a first embodiment includes a step S10 in which the cleaner 1 or 1' acquire the tilt information. Based on the tilt information acquired in the tilt information acquisition step S10, satisfaction or unsatisfaction of the tilt condition is determined in a step S20. When satisfaction of the tilt condition is determined in the step S20, the cleaner 1 or 1' performs the mop separation error response operation in S60. When unsatisfaction of the tilt condition is determined in the step S20, the cleaner 1 or 1' performs the normal travel in the step S91.

Figure 14:
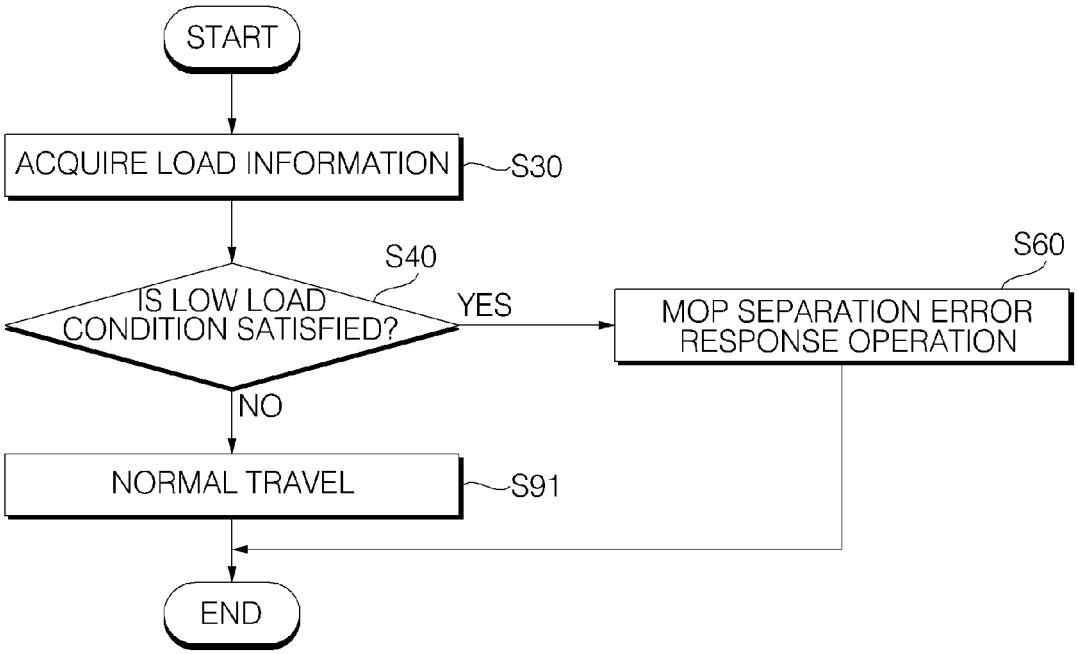
FIG. 14 is a flowchart illustrating a control method of the cleaner 1 or 1' according to a second embodiment of the present invention.

Referring to FIG. 14, a control method according to a second embodiment includes a step S30 in which the cleaner 1 or 1' acquires the load information. Based on the load information acquired in the load information acquisition step S30, satisfaction or unsatisfaction of the low load condition is determined in a step S40. When satisfaction of the low load condition is determined in the step S40, the cleaner 1 or 1' performs the mop separation error response operation in the step S60. When unsatisfaction of the low load condition is determined in the step S40, the cleaner 1 or 1' performs the normal travel in the step S91.

Figure 15:
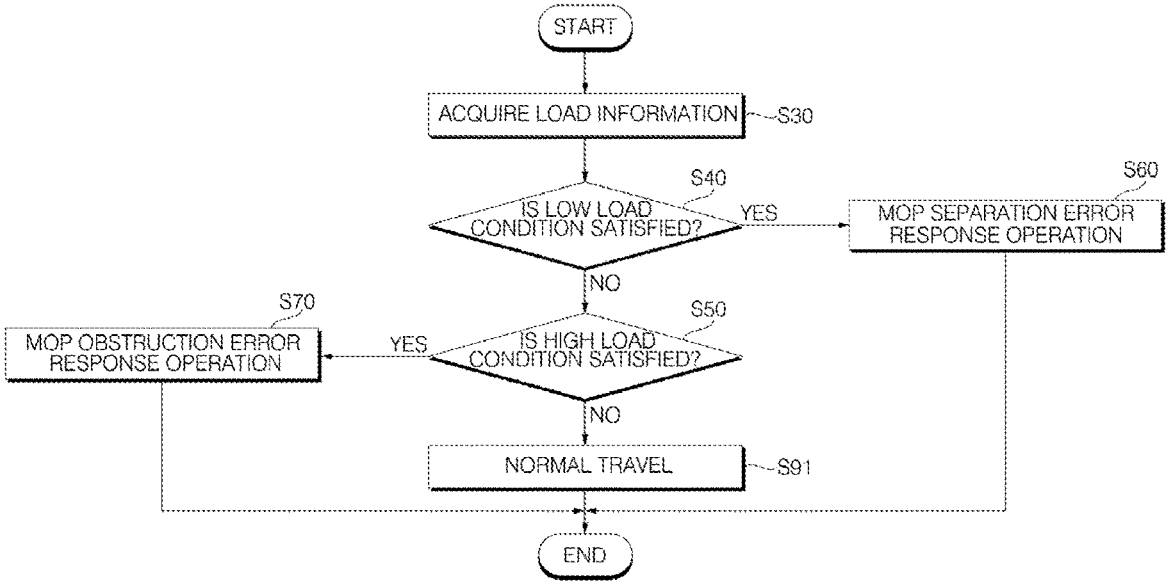
FIG. 15 is a flowchart illustrating a control method of the cleaner 1 or 1' according to a third embodiment of the present invention.

Referring to FIG. 15, a control method according to a third embodiment includes a step S30 in which the cleaner 1 or 1' acquires the load information. Based on the load information acquired in the load information acquisition step S30, satisfaction or unsatisfaction of the low load condition is determined in the step S40. When satisfaction of the low load condition is determined in the step S40, the cleaner 1 or 1' performs the mop separation error response operation in the step S60. When unsatisfaction of the low load condition is determined in the step S40, satisfaction or unsatisfaction of the high load condition is determined based on the load information in a step S50. When satisfaction of the high load condition is determined in the step S50, the cleaner 1 or 1' performs the mop obstruction error response operation in a step S70. When unsatisfaction of the high load condition is determined in the step S50, the cleaner 1 or 1' performs the normal travel in a step S91.

Figure 16:
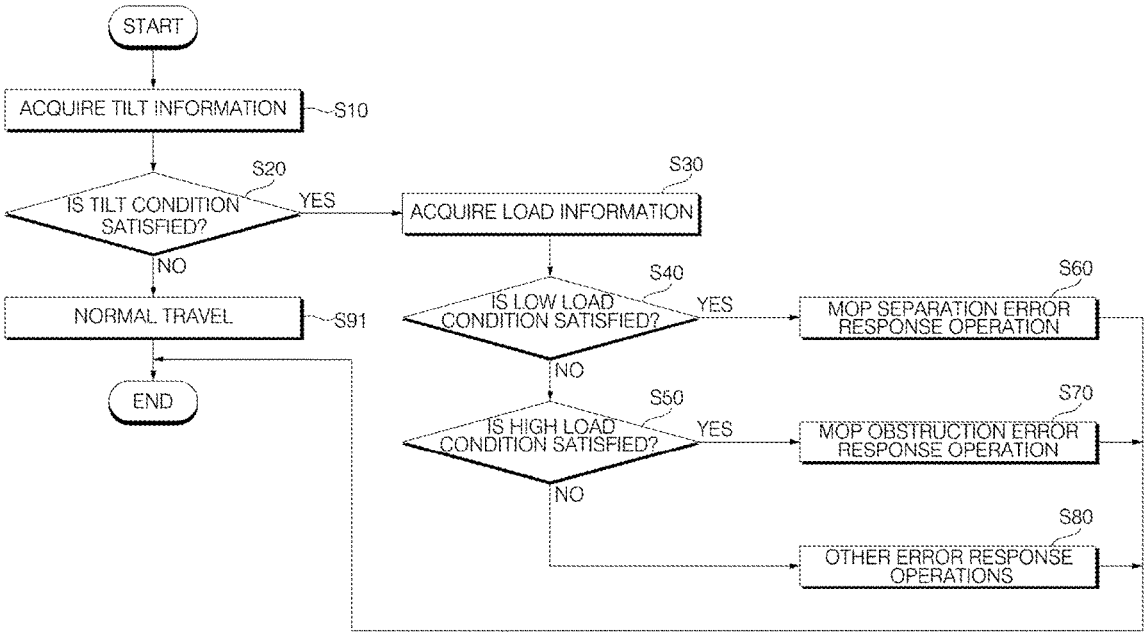
FIG. 16 is a flowchart illustrating a control method of the cleaner 1 or 1' according to a fourth embodiment of the present invention.

Referring to FIG. 16, a control method according to a fourth embodiment includes the step S10 of acquiring tilt information. Based on the tilt information acquired in the step S10, the cleaner 1 or 1' proceeds with a step S20. When unsatisfaction of the tilt condition is determined in the step S20, the cleaner 1 or 1' performs the normal travel in a step S91. When satisfaction of the tilt condition is determined in the step S20, the cleaner 1 or 1' proceeds with the step S30 of acquiring load information. Based on the load information acquired in the step S30, the cleaner 1 or 1' proceeds with the step S40. When the load condition is determined in the step S40, the cleaner 1 or 1' performs the mop separation error response operation in a step S60. When unsatisfaction of the low load condition is determined in the step S40, the step S50 is proceeded based on the load information. When satisfaction of the high load condition is determined in the step S50, the cleaner 1 or 1' performs the mop obstruction error response operation in a step S70. When unsatisfaction of the high load condition is determined in the step S50, the cleaner 1 or 1 performs other error response operations in a step S80.

Figure 17:
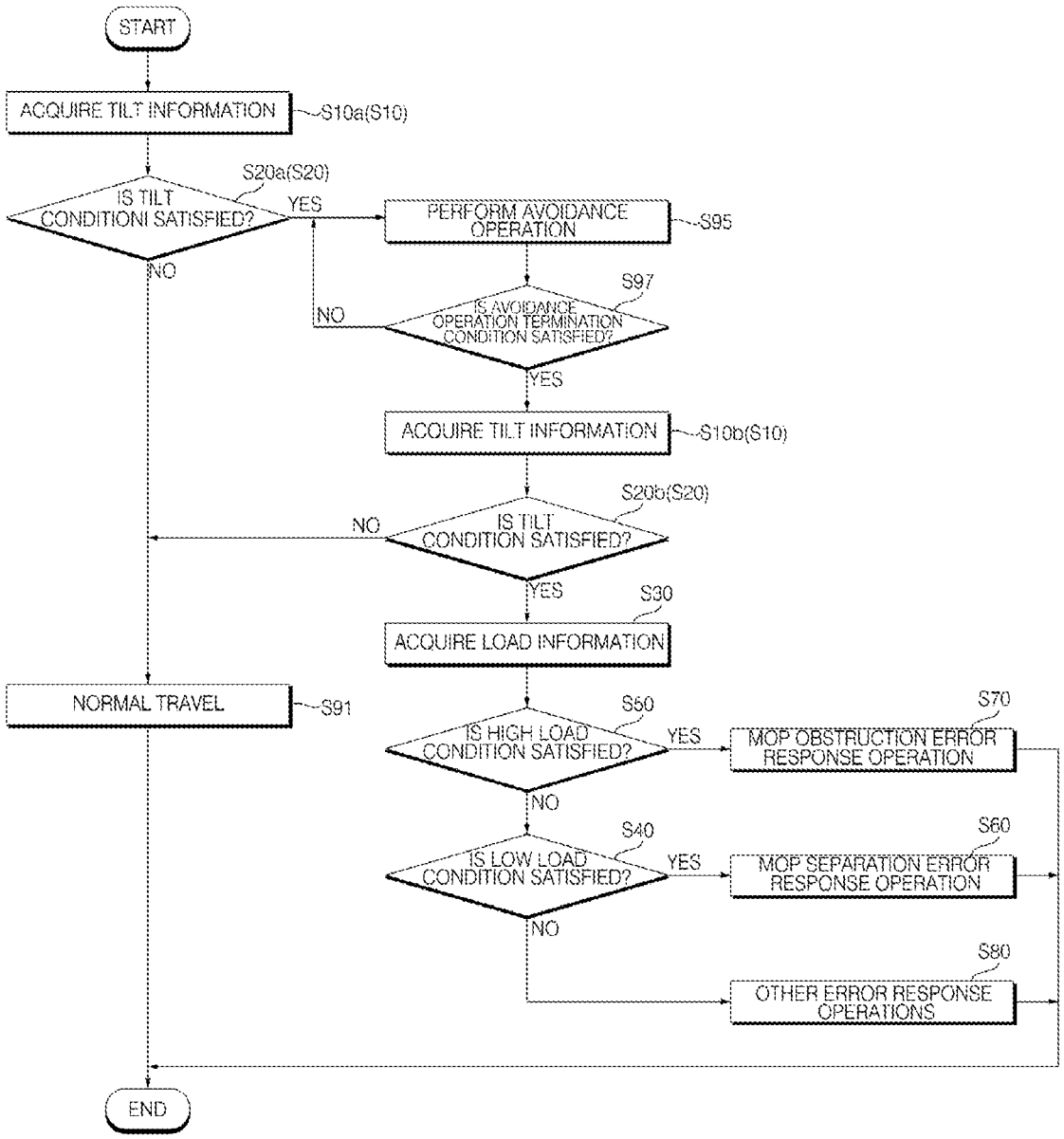
FIG. 17 is a flowchart illustrating a control method of the cleaner 1 or 1' according to a fifth embodiment of the present invention.

Referring to FIG. 17, a control method according to a fifth embodiment includes a step S10*a* of acquiring tilt information. Based on the tilt information acquired in the step S10*a*, satisfaction or unsatisfaction of the tilt condition is determined in a step S20*a*. When unsatisfaction of the tilt condition is determined in the step S20*a*, the cleaner 1 or 1' performs the normal travel in the step S91. When satisfaction of the tilt condition is determined in the step S20*a*, the cleaner 1 or 1' performs an avoidance operation in a step S95. The avoidance operation in the step S95 may be an operation pattern preset to avoid an obstacle positioned below the mop 411. The step S95 may be proceeded until the avoidance operation termination condition is satisfied. Specifically, during the step S95, satisfaction or unsatisfaction of the avoidance operation termination condition is determined in a step S97. When unsatisfaction of the avoidance operation termination condition is determined in the step S97, the avoidance operation keeps being performed in the step S95. When satisfaction of the avoidance operation termination condition is determined in the step 97, the step S95 is terminated and the step S10*b* of acquiring tilt information is proceeded. Based on the tilt information acquired in the step S10*b*, satisfaction or unsatisfaction of the tilt condition is determined in a step S20*b*. When unsatisfaction of the tilt condition is determined in the step S20*b*, the cleaner 1 or 1' performs the normal travel in a step S91. When satisfaction of the tilt condition is determined in the step S20*b*, load information acquisition is acquired in the step S30. Based on the load information acquired in the step S30, the step S50 is proceeded. When satisfaction of the high load condition is determined in the step S50, the cleaner 1 or 1' proceeds with the step S70. When satisfaction of the high load condition is determined in the step S50, the cleaner 1 or 1' proceeds with the step S40. When satisfaction of the low load condition is determined in the step S40, the step S60 is performed. When unsatisfaction of the low load condition is determined in the step S40, the step S80 is proceeded.

Figure 18:
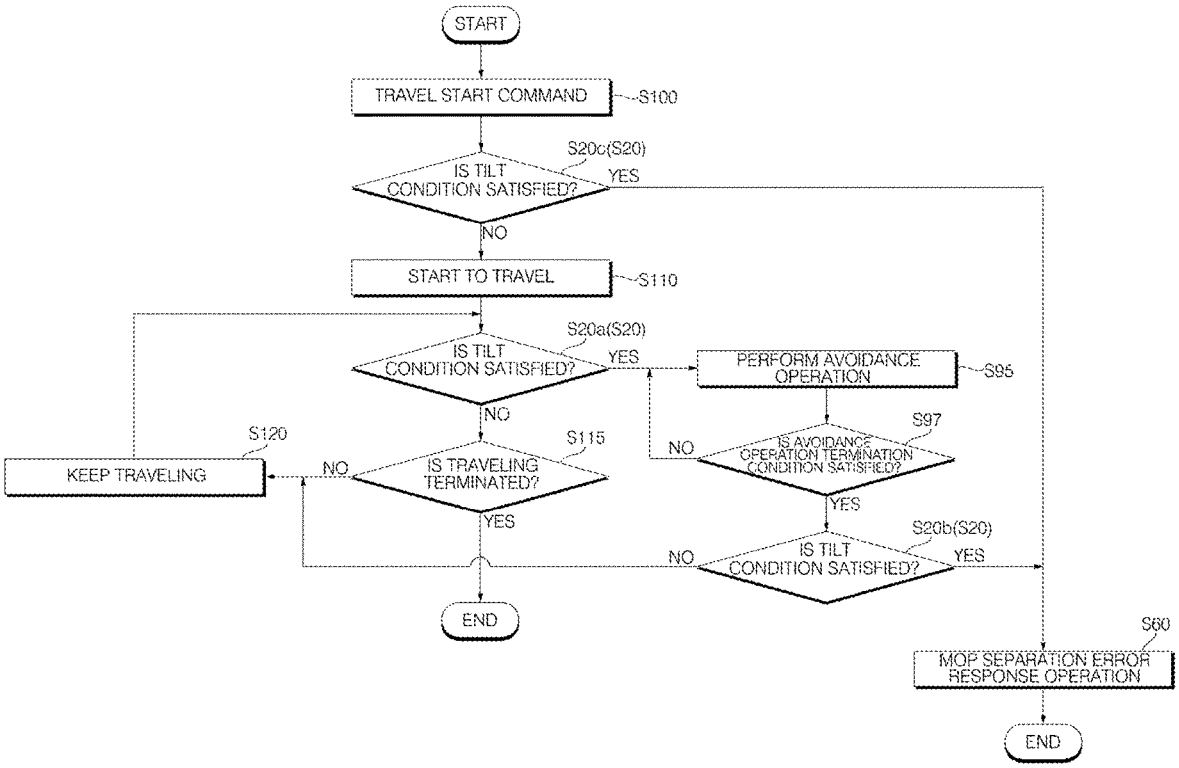
FIG. 18 is a flowchart illustrating a control method of the cleaner 1 or 1' according to a sixth embodiment of the present invention.
Figure 19:
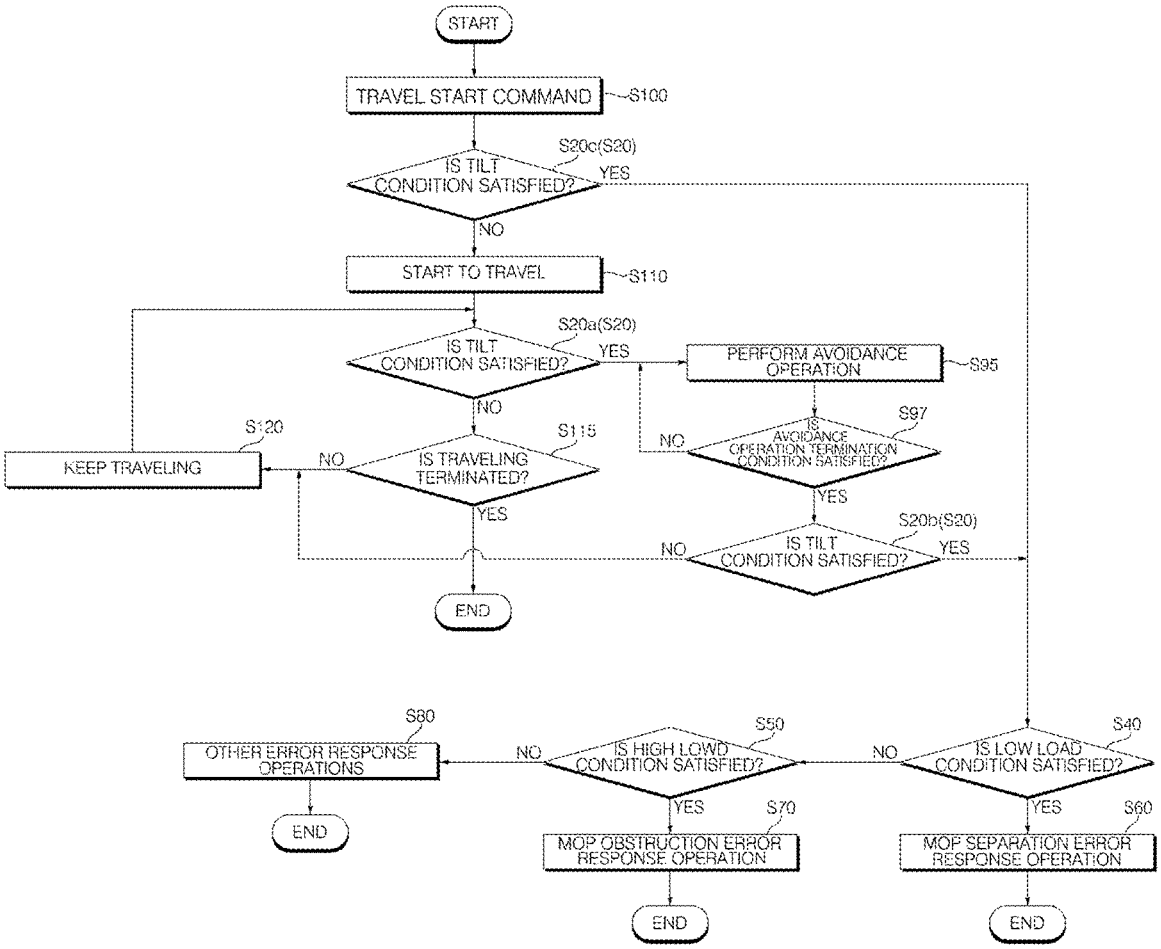
FIG. 19 is a flowchart illustrating a control method of the cleaner 1 or 1' according to a seventh embodiment of the present invention.

A control method according to sixth and seventh embodiments with reference to FIGS. 18 and 19 includes a step s100 in which the cleaner 1 or 1' receives a travel start command in a stopped state. For example, while stopped at a docking device for charging, the cleaner 1 or 1' may receive the travel start command. The travel start command may be a signal based on a user's input or may be a signal generated by the controller 10 for cleaning reservation or the like. In the step S100, after the cleaner 1 or 1' receives the travel start command, satisfaction or unsatisfaction of the tilt condition is determined in a step S20*c*. When satisfaction of the tilt condition is determined in the step S20*c*, the cleaner 1 or 1' starts to travel in a step S110. After the step S110, the step S20*a* is proceeded during traveling of the cleaner 1 or 1'. When unsatisfaction of the tilt condition is determined in the step S20*a*, the cleaner 1 or 1' continuously performs a normal travel in a step S120 unless the traveling is terminated in a step S115. In addition, if the cleaner 1 or 1' continuously traveles in S120, the cleaner 1 or 1' may need to continuously determine satisfaction or unsatisfaction of the tilt condition in a step S20*a*. When unsatisfaction of the tilt condition is determined in the step S20*a*, the step S95 and the step S97 related to performing the avoidance operation are proceeded. When satisfaction of the avoidance operation termination condition is determined in the step S97, the step S95 is terminated, and the tilt information is acquired to proceed with the step S20*b*. When unsatisfaction of the tilt condition is determined in the step S20*b*, the cleaner 1 or 1' continuously travels in the step S120 and proceeds the step S20*a* during the traveling.

Figure 8:
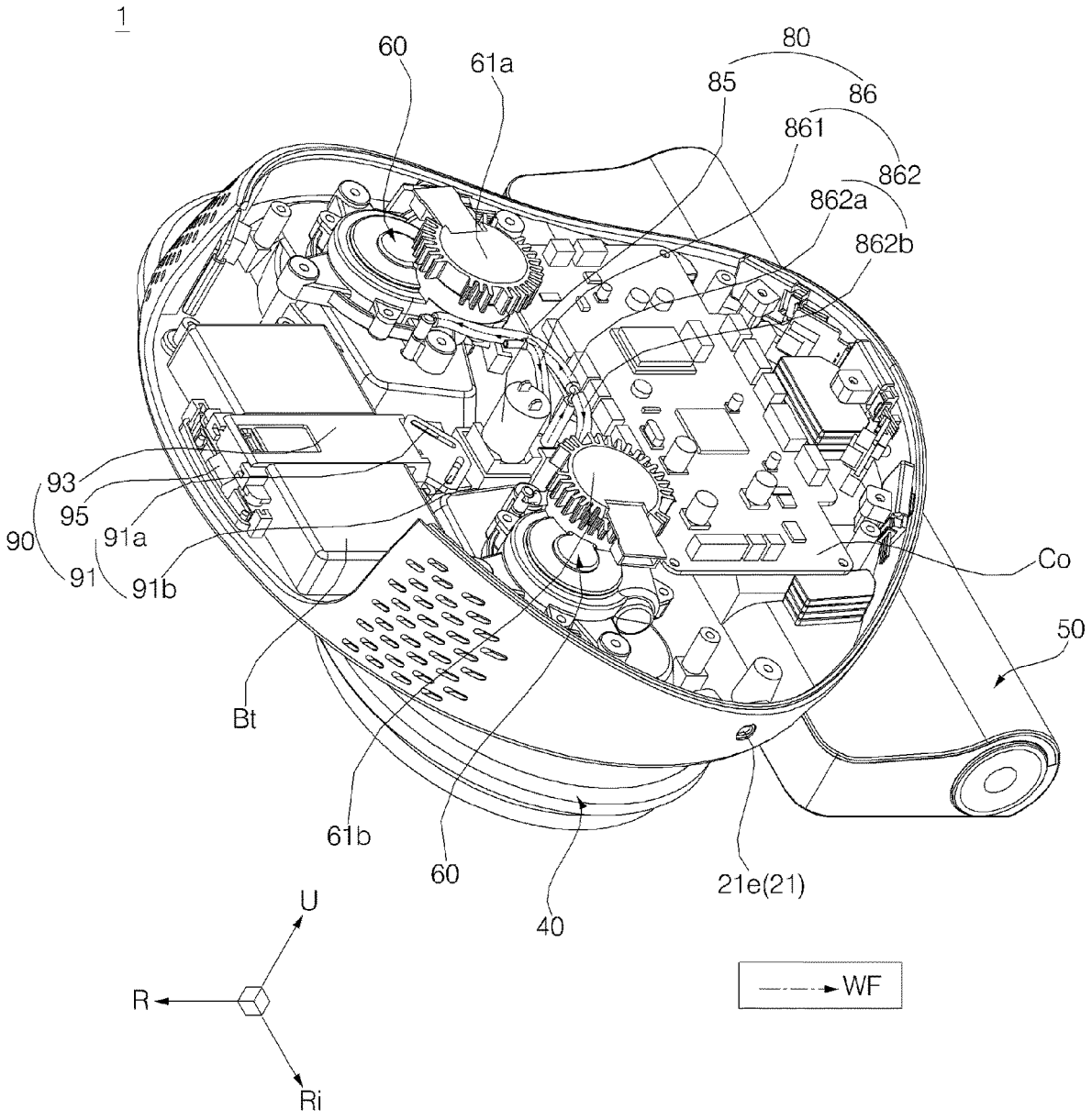

In the sixth embodiment with reference to FIG. 8, if satisfaction of the tilt condition is determined in the step S20*b*, it proceeds to the step S60.

In the seventh embodiment with reference to FIG. 19, when satisfaction of the tilt condition is determined in the step S20*b*, the step S40 is proceeded by acquiring the load information. When satisfaction of the low load condition is determined in the step S40, the step S60 is proceeded. When unsatisfaction of the low load condition is determined in the step S40, the step S50 is proceeded. When satisfaction of the high load condition is determined in the step S50, the step S70 is proceeded. When unsatisfaction of the high load condition is determined in the step S50, the step S80 is proceeded.

Hereinafter, with reference to FIGS. 4 to 12, a cleaner 1 implemented by a combination of the embodiment A, the first detachment embodiment, and the fourth detachment embodiment is described in detail. However, a cleaner according to the present invention is not limited thereto.

The cleaner 1 is provided with the body 30 that is capable of moving only by rotation of at least one from the mop module 40 and the auxiliary module 50, without an additional driving wheel. In this embodiment, the body 30 is capable of moving even by rotation of the mop module 40 alone.

The cleaner 1 includes a case 31 that defines an exterior appearance of the body 30. The case 31 defines a three-dimensional (3D) curved surface that is convex upward. The cleaner 1 includes a base 32 that defines a bottom surface of the body 30. The base 32 defines a bottom surface, a front surface, a rear surface, a left side surface, and a right side surface of the body 30. The mop module 40 is coupled to the base 32. The auxiliary module 50 is coupled to the base 32. A main Printed Circuit Board (PCB) Co and a battery Bt are arranged in an inner surface formed by the case 31 and the base 32. In addition, the mop 60 is disposed inside the body 30. The water supply module 80 is disposed inside the body 30. The detachable module 90 is disposed inside the body 30.

The cleaner 1 includes a module housing 42 that defines an exterior appearance of the mop module 40. The module housing 42 is disposed in the lower side of the body 30. The cleaner 1 includes a module cabinet 52 that defines an exterior appearance of the auxiliary module 50. The module cabinet 52 is disposed in the lower side of the body 30. The module housing 42 and the module cabinet 52 are spaced apart from each other in a front-rear direction.

The cleaner 1 includes an auxiliary wheel 58 that is spaced apart from the mop module 40 in the front-rear direction.

The cleaner 1 may include a battery slot 39*b* for replacing the battery Bt. The battery slot 39 is disposed at the bottom surface of the body 30.

The cleaner 1 includes a manipulation unit 953 that separates the body 30 and the mop module 40 from the coupled state. The operation unit 953 is exposed to the outside of the cleaner 1. If the operation unit 953 is pressed, the mop module 40 may be unlocked from the body 30.

The body 30 according to this embodiment includes the case 31 and the base 32.

The body 30 includes a module holder 36 to which the mop module 40 is detachably coupled. The body 30 includes a plurality of module holders 36*a* and 36*b* spaced apart from each other. The plurality of module holders 36*a* and 36*b* may include a pair of module holders 36*a* and 36*b*.

The module holder 36 include a bottom surface portion 361 that defines a bottom surface. The bottom surface portion 361 is in contact with an upper surface 431 of a body holder 43 in the coupled state.

The module holder 36 includes a periphery correspondence part 363 that is disposed along the circumference of the bottom surface portion 361. In the coupled state, the periphery correspondence part 363 contacts a periphery part 433 of the body holder 43. The periphery correspondence part 363 forms an incline surface that connects the bottom surface of the base 32 and the lower bottom portion 361. The periphery correspondence part 363 has an upward incline from the bottom surface of the base 32 toward the lower surface portion 361. The periphery correspondence part 363 is disposed to surround the lower surface portion 361.

The plurality of module holders 36 includes a pair of locking surfaces 363*a* to be inserted between the plurality of body holders 43. The locking surfaces 363*a* is disposed in a region of the periphery correspondence part 363 of at any one module holder 36, the region which is close to the other adjacent module holder 36. The locking surface 363*a* forms part of the periphery correspondence part 363.

The module holder 36 may form a joint hole (not shown) through which at least a part of a master joint 65 is exposed. The joint hole is formed at the bottom surface portion 361. The master joint 65 may be disposed by passing through the joint hole.

On a surface of the module holder 36, a protruding stopping part 915 is provided. The stopping part 915 may be formed as a hook type. The stopping part 915 may be disposed at the periphery correspondence part 363. The bottom surface of the protruding distal end of the stopping part 915 may have an upward incline so that an end portion thereof becomes closer to the upper side.

The stopping part 915 may elastically move in a protruding direction. The stopping part 915 is pressed in a process of coupling the body holder 43 to the module holder 36, and the stopping part 915 protrudes by an elastic force in the coupled state to be inserted into a stopping correspondence part 435. The stopping part 915 protrudes through a hole formed at the locking surface 363*a*.

The mop module 40 according to this embodiment is provided to perform wet-mopping with water contained in a water tank 81. The plurality of mop units 41*a* and 41*b* are provided to perform a mopping task by rotating in contact with a floor. The plurality of mop units 41*a* and 41*b* is connected to each other to form one set. When the coupled state is changed into the separated state, the plurality of mop units 41*a* and 41*b* connected by the mop module 40 is separated from the body 30. In addition, when the separated state is changed into the coupled state, the plurality of mop units 41*a* and 41*b* connected by the mop module 40 is coupled to the body 30.

The mop module 40 is detachably coupled to the body 30. The mop module 40 is coupled to the lower side of the body 30. The mop module 40 is provided to make the body 30 tilt in relation to the floor H due to gravity when the mop module 40 is separated from other parts Q of the cleaner 1 except for the mop module 40.

The mop module 40 includes the body holder 43. The body holder 43 is detachably coupled to the module holder 36. The body holder 43 protrudes upward from the mop module 40. The module holder 36 is recessed upward to be engaged with the body holder 43 in the body 30.

The mop module 40 includes a plurality of body holder 43*a* and 43*b* spaced apart from each other. The plurality of body holders 43*a* and 43*b* corresponds to the plurality of mop units 41*a* and 41*b*. The plurality of module holders 36*a* and 36*b* corresponds to the plurality of body holders 43*a* and 43*b*. The plurality of body holders 43*a* and 43*b* may include a pair of body holders 43*a* and 43*b* spaced apart from each other in the left-right direction.

The body holder 43 includes a top surface portion 431 that defines the top surface. In the coupled state, the top surface portion 431 contacts the bottom surface portion 361 of the module holder 36. The top surface portion 431 faces the top. The top surface portion 431 may be horizontally formed. The top surface portion 431 is disposed on the top of the periphery part 433.

The body holder 43 includes the periphery part 433 that is disposed to surround the circumference of the top surface portion 431. In the coupled state, the periphery part 433 contacts the periphery correspondence part 363 of the module holder 36. The periphery part 433 forms an incline surface that makes the top surface of the module housing 42 and the top surface portion 431 extend. The periphery part 433 has an upward incline from the top surface of the module housing 42 toward the top surface portion 431. The periphery part 433 is disposed to surround the top surface portion 431.

The body holder 43 includes a stopping correspondence surface 433*a* that contacts the stopping surface 363*a* in the coupled state. The plurality of body holders 43 includes a pair of stopping correspondence surfaces 433*a*. The pair of stopping correspondence surfaces 433*a* obliquely faces each other in the left-right direction. The stopping correspondence surface 433*a* forms part of the periphery part 433.

The body holder 43 forms a driving hole 434 through which at least part of a slave joint 415 is exposed. The driving hole 434 is formed at the top surface 431. In the coupled state, the master joint 65 may be inserted into the driving hole 434 to be connected to the slave joint 415.

On a surface of the body holder 43, a stopping correspondence part 435 recessed to be engaged with the stopping part 915 in the coupled state is provided. The stopping correspondence part 435 may be a hole or groove formed on the surface of the body holder 43. The stopping correspondence part 435 may be disposed at the periphery part 433. A plurality of stopping correspondence parts 435 corresponding to the plurality of stopping parts 915 may be provided.

The stopping part 915 is engaged with the stopping correspondence part 435. The stopping correspondence part 435 is formed on the stopping correspondence surface 433*a*.

Each of the first mop unit 41*a* and the second mop unit 41*b* includes a mop 411, a rotation plate 412, and a spin shaft 414. Each of the first mop unit 41*a* and the second mop unit 41*b* includes a water supply accommodation part 413. Each of the first mop unit 41*a* and the second mop unit 41*b* includes a slave joint 415.

FIG. 8 shows an intersection point between a spin rotation axis Osa of the first mop unit 41*a* and the bottom surface of the mop unit 41*a*, and an intersection point between a spin rotation axis Osb of the second mop unit 41*b* and the bottom surface of the second mop unit 41*b*. As viewed from the bottom, a clockwise rotational direction of the first mop unit 41*a* is defined as a first forward direction w1*f*, and a counter-clockwise rotational direction of the first mop unit 41*a* is defined as a first reverse direction w1*r*. As viewed from the bottom, a counter-clockwise rotational direction of the second mop unit 41*b* is defined as a second forward direction w2*f*, and a clockwise rotational direction of the second mop unit 41*b* is defined as a second reverse direction w2*r*. In addition, as viewed from the bottom, "an acute angle of an inclined direction of the bottom surface of the left spin mop 40*a* relative to the left-right direction axis" and "an acute angle of an inclined direction of the bottom surface of the right spin mop 40*b* relative to the left-right direction axis" are defined as inclined direction angles Ag1*a* and Ag1*b*. The inclined direction angle Ag1*a* of the left spin mop 40*a* and the inclined direction angle Ag1*b* of the right spin mop 40*b* may be identical to each other. In addition, with reference to FIG. 6, "an angle of a bottom surface I of the left spin mop 40*a* relative to a virtual horizontal plane H" and "an angle of the bottom surface I of the left spin mop 40*a* relative to the virtual horizontal plane H" are defined as inclination angles Ag2*a* and Ag2*b*.

Referring to FIG. 8, the bottom surface of the first mop unit 41*a* and the bottom surface of the second mop unit 41*b* are disposed obliquely. The inclination angle Ag2*a* of the first mop unit 41*a*, and the inclination angle Ag2*a* or Ag2*b* of the second mop unit 41*b* form an acute angle.

The bottom surface of the first mop unit 41*a* entirely forms a downward incline in the left direction. In a broad sense, the bottom surface of the second mop unit 41*b* forms a downward incline in the right direction. The bottom surface of the first mop unit 41*a* forms the lowest point Pla on the left portion. The bottom surface of the first mop unit 41*a* forms the highest point Pha on the right portion. The bottom surface of the second mop unit 41*b* forms the lowest point Plb on the right side. The bottom surface of the second mop unit 41*b* forms the highest point Phb on the left portion.

As viewed from the bottom, a tilt direction of the bottom surface of the left spin mop 120*a* forms an inclined direction angle Ag1*a* in a counter-clockwise direction relative to the left-right direction axis, and an inclined direction of the bottom surface of the right spin mop 120*b* forms an inclined direction angle Ag1*b* in a clockwise direction relative to the left-right direction axis.

Movement of the cleaner 1 is implemented by friction of the mop module 40 against the ground floor.

The mop unit 41 includes the rotation plate 412 that is rotatably provided below the body 30. The rotation plate 412 may be formed as a circular plate member. The mop 411 is fixed onto the bottom surface of the rotation plate 412. The rotation plate 412 rotates the mop 411. The spin shaft 414 is fixed onto the center of the rotation plate 412.

The rotation plate 412 includes a mop fixing part (not shown) to which the mop 411 is fixed. The mop fixing part may make the mop 411 to be detachably fixed thereto. The mop fixing part may be Velcro disposed at the bottom of the rotation plate 412. The mop fixing part may be a hook disposed at the edge of the rotation plate 412.

A water supply hole 412*a* penetrating the rotation shaft in the upward-downward direction is formed. Through the water supply hole 412*a*, water contained in a water supply space Sw moves downward of the rotation plate 412. Through the water supply hole 412*a*, water contained in the water supply space Sw moves to the mop 411. The water supply hole 412*a* is disposed at the center of the rotation plate 412. The water supply hole 412*a* is disposed at a location which avoids the spin shaft 414.

The rotation plate 412 may have a plurality of water supply holes 412*a* formed thereon. Connection parts 412*b* is disposed between the plurality of water supply holes 412*a*. the connection parts 412*b* connect a portion of a centrifugal direction XO of the rotation plate 412 and a portion of a counter-centrifugal direction XI. The centrifugal direction XO indicates a direction distal from the spin shaft 414, and the counter-centrifugal direction indicates a direction closer to the spin shaft 414.

A plurality of water supply holes 412*a* may be spaced apart from each other in a circumferential direction of the spin shaft 414. The plurality of connection parts 412*b* may be spaced apart from each other in the circumferential direction of the spin shaft 414. The water supply holes 412*a* are disposed between the connection parts 412*b*.

The rotation plate 412 includes an inclined part 412*d* disposed at the lower portion of the spin shaft 414. Water contained in the water supply space Sw flows down along the inclined part 412*d* by gravity. The inclined part 412*d* is formed along the circumference of the bottom of the spin shaft 414. The inclined part 412*d* forms a downward incline in the counter-centrifugal direction Xi.

The mop unit 41 includes the mop 411 that is coupled to the bottom of the rotation plate 412 to contact a floor. The mop may be provided on the rotation plate 412 fixedly or replaceably.

The mop 411 may include a mop alone or may include a mop and a spacer (not shown). The mop is a part that contacts a floor to perform a mopping task. The spacer ay be disposed between the rotation plate 412 and the mop to adjust the position of the mop. The spacer may be detachably fixed onto the rotation plate 412, and the mop may be detachably fixed onto the spacer. In addition, the mop may be detachably fixed directly onto the rotation plate 412, without the spacer.

The mop unit 41 includes a spin shaft 414 that rotates the rotation plate 412. The spin shaft 414 is fixed onto the rotation plate 412 to transfer a rotational force of the mop driving unit 60 to the rotation plate 412. The spin shaft 414 is connected to the top of the rotation plate 412. The spin shaft 414 is disposed at the center of the top of the rotation plate 412. The spin shaft 414 includes a joint fixing portion 414*a* that fixes the slave joint 415. The joint fixing portion 414*a* is disposed at the top of the spin shaft 414.

The spin shaft 414 extends in a direction vertical to the rotation plate 412. A tilt angle of the spin shaft 414 relative to a vertical axis may vary depending on rotation about a tilting shaft 48 of the tilting frame 47. When the tilting frame 47 tilts, the spin shaft 414, the rotation plate 412, the water supply accommodation part 413, the slave joint 415, and the mop 411 may tilt altogether along with the tilting frame 47.

The mop module 40 includes the water supply accommodation part 413 that is disposed above the rotation plate 412 to contain water. The water supply accommodation part 413 forms a water supply space SW in which water is contained. The water supply accommodation part 413 surrounds the circumference of the spin shaft 414 while being spaced apart from the spin shaft 414, thereby forming the water supply space Sw. The water supply accommodation part 413 may allow water to be collected in the water supply space Sw before water supplied to the upper side of the rotation plate 412 to pass through the water supply hole 412*a*. The water supply space Sw is disposed at the center of the top of the rotation plate 412. The water supply space Sw has a cylindrical volume. The top of the water supply space Sw is open. The water supply space Sw is provided to allow water to flow thereinto through the top thereof.

The water supply accommodation part 413 protrudes upward of the rotation plate 412. The water supply accommodation part 413 extends along a circumferential direction of the spin shaft 414. The water supply accommodation part 413 may be formed in the shape of a ring-type rib. The water supply accommodation part 413 may include a water supply hole 412*a* formed at an inner bottom surface.

The lower portion of the water supply accommodation part 413 is fixed onto the rotation plate 412. The upper portion of the water supply accommodation part 413 has a free end.

The mop unit 41 includes the slave joint 415 that is rotated as being engaged with the master joint 65 of the mop driving unit 60 in the coupled state. At least part of the slave joint 415 is exposed to the outside of the mop module 40.

Figure 4:
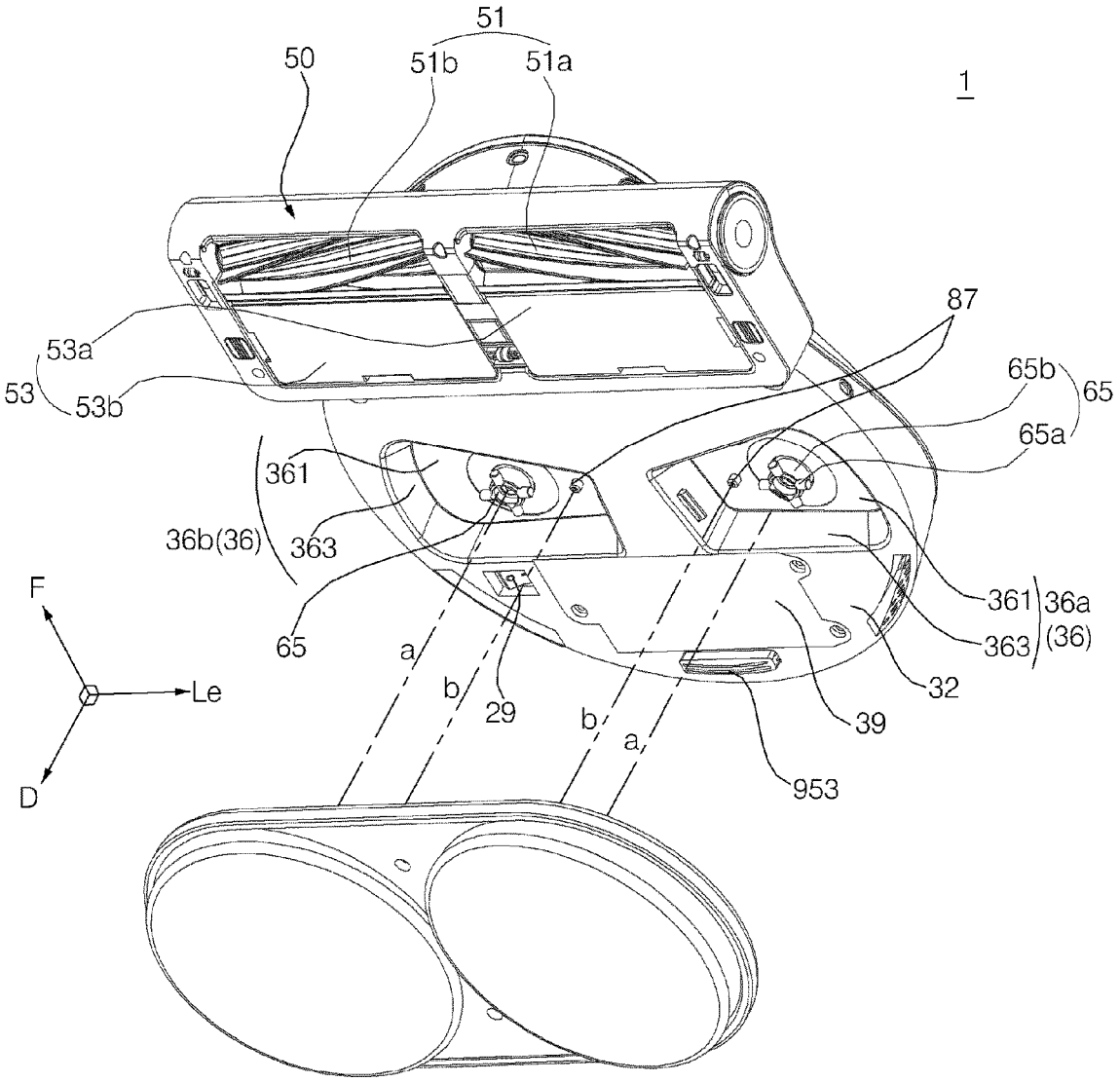
FIGS. 4 to 11 are diagrams illustrating the cleaner 1 according to the embodiment A of FIG. 1, the first detachment embodiment of FIG. 2A, and the fourth detachment embodiment of FIG. 2D.
Figure 5:
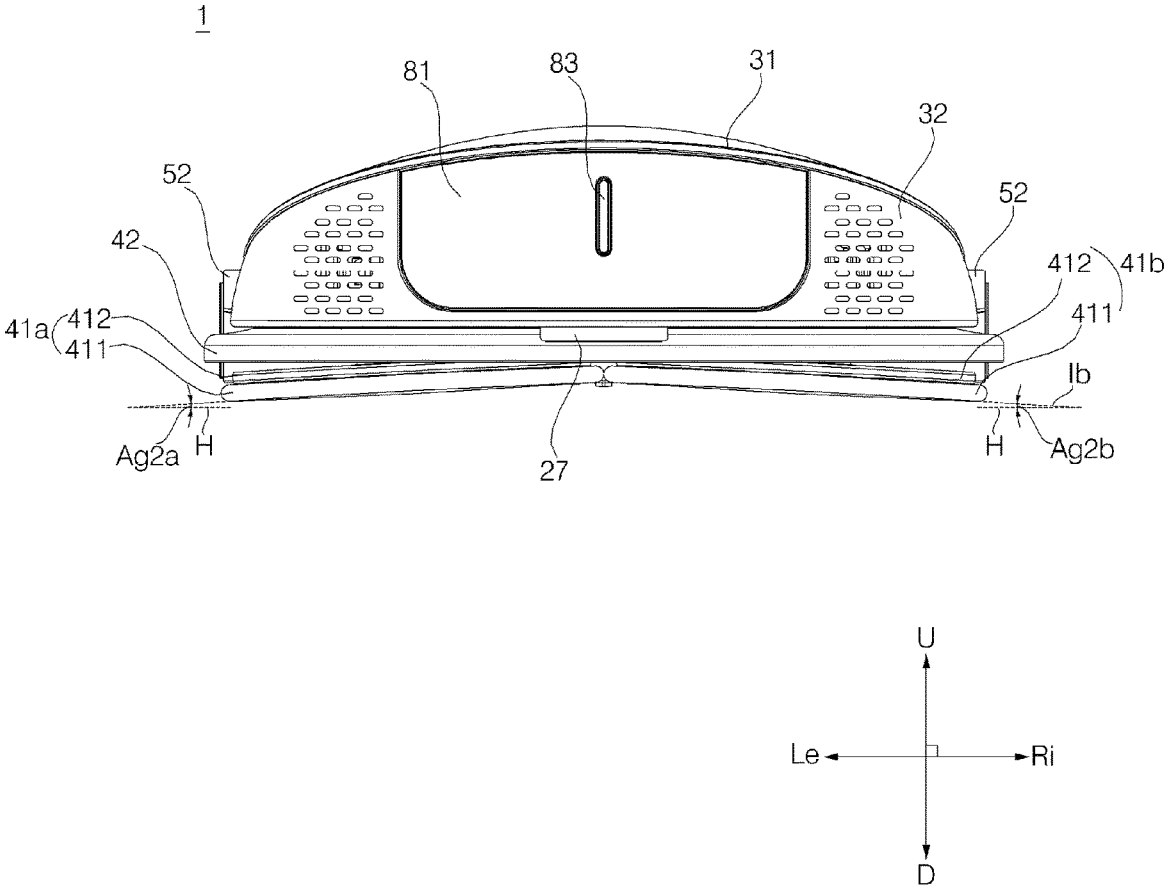

Referring to dotted lines a in FIGS. 2*a* and 4, the master joint 65 and the slave joint 415 are separated from each other in the separated state. In the coupled state, the master joint 65 and the slave joint 415 are engaged with each other.

The slave joint 415 forms a plurality of driving grooves 415*h* disposed in a circumferential direction around the rotation axis of the slave joint 415. The plurality of driving grooves 415*h* is spaced apart at a predetermined interval from each other.

The slave joint 415 includes a plurality of opposing protrusions 415*a* that is spaced apart from each other in a circumferential direction around the rotation axis of the slave joint 415. The plurality of opposing protrusions 415*a* protrudes toward the master joint 65.

The plurality of opposing protrusions 415*a* is spaced apart at a predetermined interval from each other. In the coupled state, any one driving protrusion 65*a* is provided to be spaced apart between two adjacent opposing protrusions 415*a*. In the separated state, the driving protrusion 65*a* is separated from the two adjacent opposing protrusions 415*a*.

A protruding end portion of each opposing protrusion 415 is formed round. The protruding end portion of each opposing protrusion 415 is formed round along a direction of arrangement of the plurality of opposing protrusions 415*a*. The protruding end portion of each opposing protrusion 415 has a round corner in a direction toward adjacent opposing protrusions 415 with reference to the central axis of the protruding direction.

The slave joint 415 is fixed onto the top of the spin shaft 414. The slave joint 415 includes a slave shaft 415*b* that is fixed to the spin shaft 414. The slave shaft 415*b* may be formed in a cylindrical shape. Each driving groove 415*h* is formed at a front of the circumference of the slave shaft 415*b*. Each driving groove 415*h* is recessed in the upward-downward direction. The plurality of driving grooves 415*h* is spaced apart from each other along the circumference of the slave shaft 415*b*. The slave joint 415 includes an opposing protrusion 415*a* that protrudes from the slave shaft 415*b*.

In the coupled state, when suspension units 47, 48, and 49 which will be described later flows within a predetermined range, the driving protrusions a61*a* and the driving grooves 415*h* are allowed to flow and engaged with each other to transfer a rotational force. Specifically, a depth of each driving groove 415*h* in the upward-downward direction is greater than a width of each driving protrusion 65*a* in the upward-downward direction, so that the rotational force of the master joint 65 is transferred to the slave joint 415 even though the driving protrusion 65*a* flows with respect to the driving groove 415*h* within a predetermined range in the upward-downward direction.

The mop module 40 includes a module housing 42 that connects the plurality of mop units 41*a* and 41*b*. The body holder 43 is disposed at the top of the module housing 42. The mop unit 41 may be rotatably supported by the module housing 42. The mop unit 41 may be disposed to penetrate the module housing 42.

The module housing 42 may include an upper cover 421 defining the upper part thereof, and an upper cover 423 defining the lower part thereof. The upper cover 421 and the lower cover 423 are coupled to each other. The upper cover 421 and the lower cover 423 form an inner space that accommodates part of the mop unit 41.

The mop module 40 includes the suspension units 47, 48, and 49 disposed at the module housing 42. The suspension unit 47, 48, and 49 supports the spin shaft 414 so that the spin shaft 414 flows within a predetermined range in the upward-downward direction. The suspension units 47, 48, and 49 according to this embodiment includes the tilting frame 47, the tilting shaft 48, and an elastic member 49.

The module housing 42 may include a limit that restricts a rotation range of the tilting frame 47.

The limit may include a lower end limit 427 that restricts a downward rotation range of the tilting frame 47. The downward limit 427 may be disposed at the module housing 42. The lower end limit 427 is provided so that the tilting frame 47 is brought into contact with a lower end limit contact portion 477 while being rotated at a maximum angle in the downward direction. While the cleaner 1 is properly disposed at an external horizontal plane, the lower end limit contact portion 477 is spaced apart from the lower end limit 427. While there is no power for pushing the bottom surface of the mop unit 41 upward, the tilting frame 47 is rotated by a maximum angle and the lower limit contact portion 477 contacts the lower limit 427 and the inclination angle Ag2*a* or Ag2*b* have the greatest value.

The limit may include an upper end limit (not shown) that restricts an upward rotation range of the tilting frame 47. In this embodiment, the upward rotation range of the tilting frame 47 may be restricted by contact between the master joint 65 and the slave joint 415. While the cleaner 1 is properly disposed at an external horizontal plane, the slave joint 415 is in the closest contact with the master joint 65 and the inclination angle Ag2*a* or Ag2*b* has the smallest value.

The module housing 42 includes a second support part 425 that fixes an end portion of the elastic member 49. When the tilting frame 47 is rotated, the elastic member 49 is elastically transforms or restored by the first support part 475, which is fixed to the tilting frame 47, and a second support part 425, which is fixed to the module housing 42.

The module housing 42 includes a tilting shaft support part 426 that supports the tilting shaft 48. The tilting shaft support part 426 supports both ends of the tilting shaft 48.

The mop module 40 includes a module water supply unit 44 that guides water, which is flown into the water supply connector 87, to be guided to the mop unit 41 in the coupled state. The module water supply unit 44 guides water from the upside to the downside. There may be provided a pair of module water supply units 44 corresponding to the plurality of mop units 41*a* and 41*b*. Water contained in the water tank 81 is supplied to the mop unit 41 through the module supply unit 44. The water contained in the water tank 81 is flown into the module water supply unit 44 through the water supply connector 87.

The module water supply unit 44 includes a water supply correspondence part 441 that receives water from the water supply module 80. The water supply correspondence part 441 is connected to the water supply connector 87. The water supply correspondence part 441 includes a groove into which the water supply connector 87 is inserted. The water supply correspondence part 441 is disposed at the body holder 43. The water supply correspondence part 441 is disposed at the upper surface 431 of the body holder 43. The water supply correspondence part 441 is formed as a surface of the body holder 43 is recessed downward.

In the coupled state, the water supply correspondence part 441 is formed at a location corresponding to the water supply connector 87. In the coupled state, the water supply connector 87 and the water supply correspondence part 441 are engaged with each other to be connected to each other. In the coupled state, the water supply connector 87 is inserted downward into the water supply connector 441. In the separated state, the water supply connector 87 is separated from the water supply correspondence part (see doted line b in FIGS. 2A and 4).

The module water supply unit 44 includes a water supply transmission unit 443 that guides water, flown into the water supply correspondence part 441, to a water supply induction unit 445. The water supply transmission unit 443 may be disposed at the module housing 42. The water supply transmission unit 443 may be formed to protrude downward from an inner top surface of the upper cover 421. The water supply transmission unit 443 may be disposed at the lower side of the water supply correspondence part 441. The water supply transmission unit 443 may be provided to drop water downward. The water supply correspondence part 441 and the water supply transmission unit 443 may form a hole connected therebetween in the upward-downward direction, and water flows downward along the hole.

The module water supply unit 44 includes the water supply induction unit 445 that guides water, flown into the water supply correspondence part 441, to the mop unit 41. The water flown into the water supply correspondence part flows into the water induction unit 445 through the water supply transmission unit 443.

The water supply induction unit 445 is disposed at the tilting frame 47. The water supply induction unit 445 is fixed onto the frame base 471. Through the water supply correspondence part 441 and the water supply transmission unit 443, water flows into a space formed by the water supply induction unit 445.

The water supply induction unit 445 may include an inlet 445*a* that forms a space recessed from the upper side to the lower side. The inlet 445*a* may accommodate the lower portion of the water supply transmission unit 443. The top of the inlet 445*a* may form an open space. Through an upper opening of the space of the inlet 445*a*, water passing through the water supply transmission unit 443 inflows. The space of the inlet 445*a* is connected to a flow path, in one side of which a flow path unit 445*b* is formed.

The water supply induction unit 445 may include the flow path unit 445*b* that connects the inlet 445*a* and an outlet 445*c*. One end of the flow path unit 445*b* is connected to the inlet 445*a*, and the other end of the flow path unit 445*b* is connected to the outlet 445*c*. A space formed by the flow path unit 445*b* is a path along which water moves. The upper side of the flow path unit 445*b* may be formed as an open channel. The flow path unit 445*b* may have a downward incline from the inlet 445*a* toward the outlet 445*c*.

The water supply induction unit 445 may include the outlet 445*c* that discharges water to the water supply space Sw of the water supply accommodation part 413. The lower end of the outlet 445*c* may be disposed within the water supply space Sw. The outlet 445*c* forms a hole connected from the inner space of the module housing 42 to the upper space of the rotation plate 412. The hole formed at the outlet 45*c* connects the two spaces in the upward-downward direction. The outlet 445*c* forms a hole that penetrates the tilting frame 47 in the upward-downward direction. The space of the flow path unit 445*b* is connected to the hole of the outlet 445*c*. the lower end of the outlet 44*c* may be disposed within the water supply space Sw of the water supply accommodation part 413.

The tilting frame 47 is connected to the module housing 42 through the tilting shaft 48. The tilting frame 47 supports the spin shaft 414 to be rotatable.

The tilting frame 47 is provided to be rotatable about the tilting rotation shaft Ota or Otb within a predetermined range. The tilting rotation shaft Ota or Otb extends in a direction that crosses rotation shafts Osa or Osb of the spin shaft 414. The tilting shaft 48 is disposed on the tilting rotation shaft Ota or Otb. A left tilting frame 47 is provided to be rotatable about the tilting rotation shaft Ota within a predetermined range. A right tilting frame 47 is provided to be rotatable about the tilting rotation shaft Otb within a predetermined range.

The tilting frame 47 is disposed to be capable of tilting within a predetermined angle range relative to the mop module 40. The inclination angle Ag2*a* or Ag2*b* of the tilting frame 47 may be changed depending of a floor condition. The tilting frame 47 may function as a suspension of the mop unit 41 (which supports weight and alleviates upward and downward vibration).

The tilting frame 47 includes a frame base 471 that defines a bottom surface thereof. The spin shaft 414 is disposed to penetrate the frame base 471 in the upward-downward direction. The frame base 471 may be formed as a plate that defines a thickness in the upward-downward direction. The tilting shaft 48 connects the module housing 42 and the frame base 471 to be rotatable.

A bearing Ba may be provided between a rotation shaft support 471 and the spin shaft 414. The bearing Ba may include a first bearing Ba disposed on the lower side, and a second bearing B2 disposed on the upper side.

The lower end of the rotation shaft support 473 is inserted into the water supply space Sw of the water supply accommodation part 413. The inner circumferential surface of the rotation shaft support 473 supports the spin shaft 414.

The tilting frame 47 includes a first support 475 that supports one end of the elastic member 49. The other end of the elastic member 49 supports a second support 425 disposed at the module housing 42. When the tilting frame 47 tilts about the tilting shaft 48, a position of the first support 475 is changed and a length of the elastic member 49 is changed.

The first support 475 is fixed to the tilting frame 47. The first support 475 is disposed at the left side of the left tilting frame 47. The first support 475 is disposed at the right side of the right tilting frame 47. The second support 425 is disposed at the left region of the first mop unit 41*a*. The second mop unit 41*b* is disposed at the right region of the second mop unit 41*b*.

The first support 475 is fixed to the tilting frame 47. Upon tilting of the tilting frame 47, the first support 475 tilts together with the tilting frame 47. A distance between the first support 475 and the second support 425 becomes the shortest in response to the minimum inclination angle Ag2*a* or Ag2*b*, and the greatest in response to the maximum inclination angle Ag2*a* or Ag2*b*. When the inclination angle Ag2*a* or Ag2*b* is minimized, the elastic member 49 is elastically transformed to provide a restoration force.

The tilting frame 47 includes the lower end limit contact portion 477 that is able to contact the lower end limit 427. The bottom surface of the lower limit contact portion 477 may be provided to be in contact with the top surface of the lower end limit 427.

The tilting shaft 48 is disposed at the module housing 42. The tilting shaft 48 becomes the rotation shaft of the tilting frame 47. The tilting shaft 48 may be disposed to extend in a direction vertical to a direction in which the mop unit 41 tilts. The tilting shaft 48 may be disposed to extend in a horizontal direction. In this embodiment, the tilting shaft 48 is disposed to extend in a direction tilting at an acute angle from the front-rear direction.

The elastic member 49 applies an elastic force to the tilting frame 47. An elastic force is applied to the tilting frame 47 so that the inclination angle Ag2*a* or Ag2*b* of the bottom surface of the mop unit 41 relative to the horizontal plane is increased.

The elastic member 49 extends when the tilting frame 48 rotates downward, whereas the elastic member 49 shrinks when the tilting frame 47 rotates upward. The elastic member 49 allows the tilting frame 47 to operate in a cushioning manner (an elastic manner). The elastic member 49 applies a moment force to the tilting frame 47 in a direction in which the inclination angle Ag2*a* or Ag2*b* is increased.

The auxiliary module 50 according to this embodiment is provided to move along with movement of the body 30. The auxiliary module 50 is provided to sweep and collect foreign substances from a floor. The auxiliary module 50 is provided to move forward and make foreign substances on a floor collected into the collecting space.

The auxiliary module 50 may include at least one collecting unit 53 that defines the collecting space (not shown) for storing the collected foreign substances. The at least one collecting unit 53 may include a plurality of collecting units 53*a* and 53*b*. The plurality of collecting units 53*a* and 53*b* may include a first collecting unit 53*a* disposed on the left side, and a second collecting unit 53*b* disposed on the right side.

The auxiliary module 50 includes at least one sweeping unit 51 that is provided to rotate in contact with a floor so as to collect foreign substances from a floor into the collecting space. The at least one sweeping unit 51 includes a plurality of sweeping units 51*a* and 51*b*. The plurality of sweeping units 51*a* and 51*b* includes a first weeping unit 51*a* disposed on the left side, and a second sweeping unit 51*b* disposed on the right side.

Figure 6:
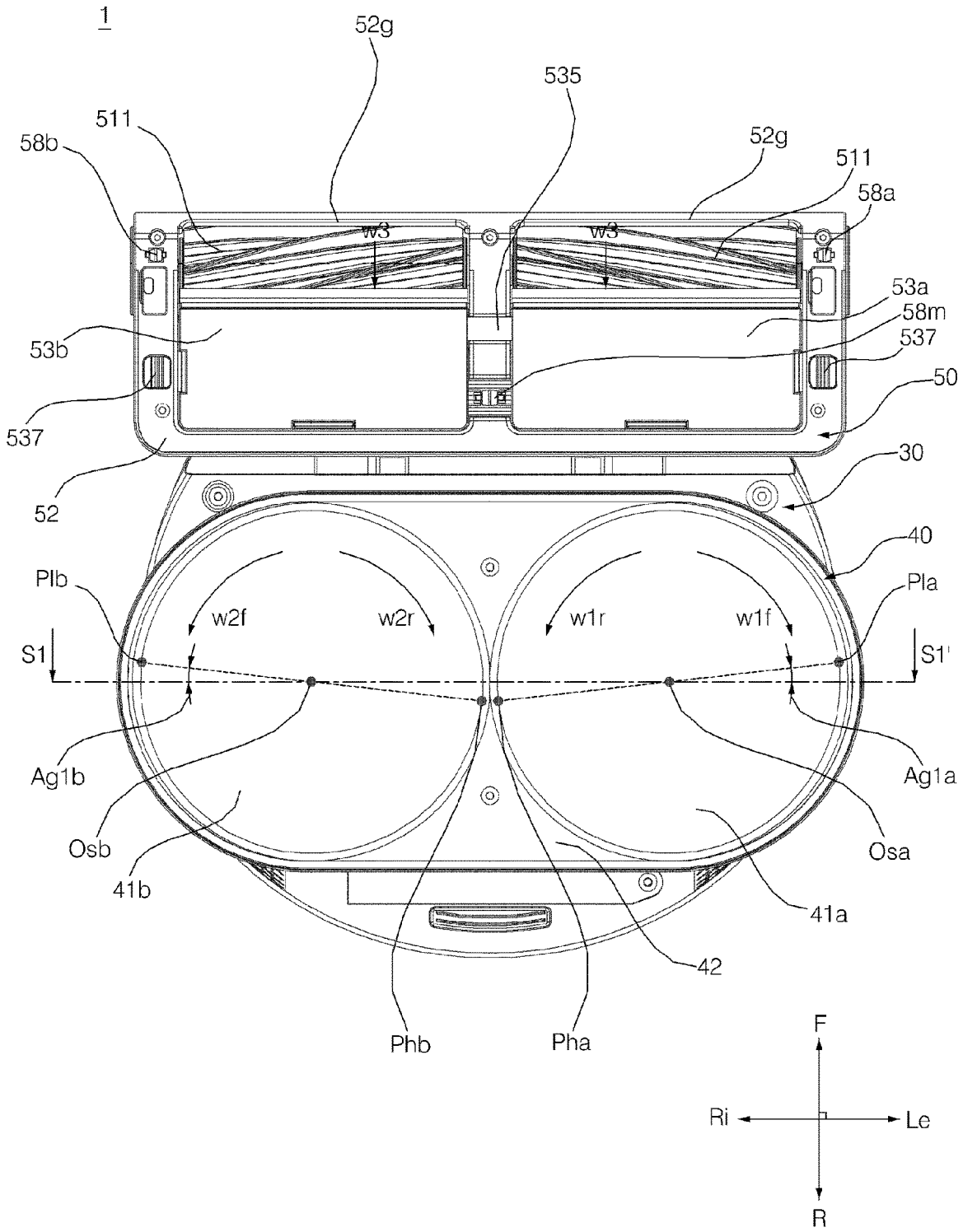
Figure 7:
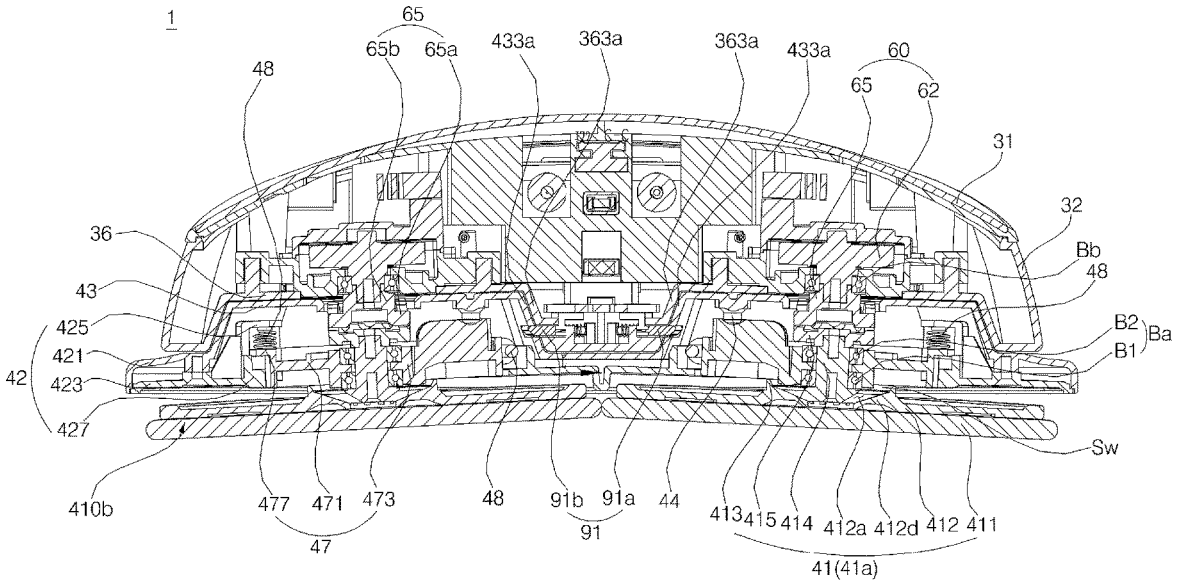

The sweeping unit 51 is provided to rotate about a sweeping rotation shaft (not shown) which substantially extends in a horizontal direction. The sweeping unit 51 may be a shaft that substantially extends in the left and right side of the sweeping rotation shaft. Referring to FIG. 6, the sweeping unit 51 rotates in a third forward direction w3 to sweep foreign substances from a floor into the collecting space located at the rear side. The third forward direction w3 indicates a counter-clockwise direction, as viewed from left side.

The sweeping unit 51 is disposed in front of the collecting unit 53. A blade 511 of the sweeping unit 51 is provided to sweep a floor and collect a relatively large-sized foreign substance into the collecting unit 53.

The sweeping unit 51 includes a blade 511 that is provided to be in direct contact with a floor. The blade 511 protrudes in a direction distal from the sweeping rotation shaft.

In this embodiment, the blade 511 is formed as a plate type, but the blade 511 may be formed as a plurality of brushes densely positioned. The blade 511 may extend in the left-right direction: specifically, the blade 511 may extend linearly along a circumference of the sweeping rotation shaft. The linear extending direction of the blade 511 of the first sweeping unit 51*a* and the linear extending direction of the blade 511 of the second sweeping unit 51*b* are opposite to each other.

The auxiliary module 50 includes a module cabinet 52 at which the sweeping unit 51 and the collecting unit 53 are disposed. The module cabinet 52 is connected to the body 30.

The module cabinet 52 defines an exterior appearance of the auxiliary module 50. The module cabinet 52 forms a bottom surface that opposes a floor (a surface to be cleaned). The module cabinet 52 forms the foremost end portion of the cleaner 1. When the module cabinet 52 collides with an external object, the cleaner 1 is able to detect an impact of the collision.

The module cabinet 52 forms a sweeping unit groove 52*g*, which is recessed upward from the bottom surface of the module cabinet 52 so that the sweeping unit 51 is disposed at the sweeping unit groove 52. The lower side of the front end of the sweeping unit groove 52*g* is open forward.

The module cabinet 52 forms a collecting unit groove (not shown), which is recessed upward from the bottom surface of the module cabinet 52 so that the collecting unit 53 is disposed at the collecting unit groove. The collecting unit groove is disposed behind the groove 52*g*. The groove 52*g* and the collecting unit groove may be connected to each other in the front-rear direction.

The collecting unit 53 forms the collecting space in which foreign substances lifted by the blade 511 from a floor is collected. The collecting space is disposed behind the sweeping unit 51. A pair of collecting units 53*a* and 53*b* forms the collecting space.

The collecting unit 53 forms an opening at the front side, the opening which is connected the collecting space. Foreign substances pushed by the sweeping unit 51 from the front to the rear are taken into the collecting space through the opening of the collecting unit 53.

The collecting unit 53 includes a set connector 535 that extends while connecting the pair of collecting units 53*a* and 53*b*. The set connector 535 is disposed between the pair of the collecting units 53. The set connector 535 is exposed downward of the module cabinet 52.

The collecting unit 53 is provided detachable from the module cabinet 52. The collecting unit 53 includes a collecting unit detachment button 537, wherein the collecting unit 53's coupling to the module cabinet 52 is decoupled when the collecting unit 53 is pressed. A pair of collecting unit detachment buttons 537 may be disposed on the left and right sides symmetrically. The pair of collecting units 53 is connected to each other by the set connectors 535, so that the pair of collecting units 53 can be coupled to or separated from the module cabinet 52 at the same time.

The auxiliary module 50 includes the auxiliary wheel 58 that is rotated in contact with a floor. The auxiliary wheel 58 is disposed below the module cabinet 52. The auxiliary wheel 58 enables forward and backward movement of the module cabinet 52 against the floor.

A plurality of auxiliary wheels 58*a*, 58*b*, and 58*m* may be provided. A pair of auxiliary wheels 58*a* and 58*b* may be provided on the left and right sides, respectively. The left auxiliary wheel 58*a* is disposed on the right side of the first sweeping unit 51*a*. The right auxiliary wheel 58*b* is disposed on the right side of the second sweeping unit 51*b*. The pair of auxiliary wheels 58*a* and 58*b* is disposed at locations symmetrical to each other in the left-right direction.

In addition, a center auxiliary wheel 58*m* may be provided. The central auxiliary wheel 58*m* is disposed between the pair of collecting units 53*a*. The central auxiliary wheel 58*m* is disposed at a location spaced apart from the pair of auxiliary wheels 58*a* an 58*b* in the front-rear direction.

The cleaner 1 includes the mop driving unit 60 that provides a driving force to rotate the mop unit 41. The mop driving unit 60 provides a rotational force to the pair of mop units 41*a* and 41*b*.

The mop driving unit 60 may be disposed symmetrically in the left-right direction. The mop driving unit 60 is disposed at the body 30. The driving force of the mop driving unit 60 is transferred to the mop unit 41. In the coupled state between the body 30 and the mop module 40, a rotational force of the mop driving unit 60 is transferred to the pair of mop units 41*a* and 41*b*. In the separated state between the body 30 and the mop module 40, a rotational force of the mop driving unit 60 is not allowed to be transferred to the mop unit 41.

The mop module 40 includes: a first mop driving unit 60 which provides a driving force to rotate the first mop unit 41*a*; and a second mop driving unit 60 which provides a driving force to rotate the second mop unit 41*b*. Hereinafter, description about each element of the mop driving unit 60 should be understood as description about the first and second mop driving units 60.

The mop driving unit 60 includes a mop motor 61 that provides a rotational force. The first mop driving unit 60 includes a first mop motor 61*a* disposed on the left side, and the second mop driving unit 60 includes a second mop motor 61 disposed on the right side. The rotational shaft of the mop motor 61 may extend in the upward-downward direction.

The mop driving unit 60 includes the master joint 65 that is rotated by the mop motor 61. The master joint 65 is exposed to the outside of the body 30.

In the coupled state, the master joint 65 is engaged with the slave joint 415. In the coupled state, the slave joint 415 is provided to be rotated upon rotation of the master joint 65. The master joint 65 is exposed downward of the body 30. The master joint 65 is exposed downward of the module holder 36. There may be a pair of master joints 65 corresponding to the pair of mop units 41*a* and 41*b*. The pair of master joints 65 is respectively engaged with the pair of slave joints 415.

The master joint 65 includes the plurality of driving protrusions 65*a* that is disposed in a circumferential direction around the rotation shaft of the master joint 65. The plurality of driving protrusions 65*a* is spaced at a predetermined interval apart from each other. In the coupled state, each driving protrusion 65*a* is inserted into a driving groove 415*h* of a corresponding slave joint 415. In the separated state, each driving protrusion 65*a* is separated from a corresponding groove 415.

The master joint 65 is disposed below the mop driving unit 60. The master joint 65 includes a driving protrusion shaft 65*b* that receives a rotational force from the driving transfer unit 62. The driving protrusion shaft 65*b* may be formed in a cylindrical shape. Each driving protrusion 65*a* protrudes from a corresponding driving protrusion shaft 65*b*. Each protrusion 65*a* protrudes in a direction distal from the rotation shaft of the master joint 65. Between the driving protrusion shaft 65*b* and the body 30, a bearing Bb may be provided.

The mop driving unit 60 includes a driving force transmitting unit 62 that transmits a rotational force of the mop motor 61. The driving force transmitting unit 62 may include a gear and/or a belt, and may include a gear shaft that acts as a rotation shaft of the gear.

The cleaner 1 may include an auxiliary driving unit (not shown) that provides a driving force of the auxiliary module 50. The auxiliary driving unit provides a driving force for rotation of the sweeping unit 51. The auxiliary driving unit provides a rotational force to a pair of sweeping units 51. The auxiliary driving unit is disposed at the auxiliary module 50.

Although not illustrated in the drawings, the auxiliary driving unit may be, in another embodiment, configured to transfer a rotational force, which is obtained by rotation of the auxiliary wheel 58 without a motor, to the sweeping unit 51.

The auxiliary driving unit includes an auxiliary motor 71. The auxiliary motor 71 may be disposed in a gap between the pair of collecting unit 53, or in a gap between the pair of sweeping units 51.

The auxiliary driving unit includes a driving force transmitting unit (not shown) that transfers a rotational force of the auxiliary motor 71 to the sweeping unit 51. The driving force transmitting unit may include a gear and/or a belt, and may include a gear shaft that acts as a rotation shaft of the gear.

Figure 9:
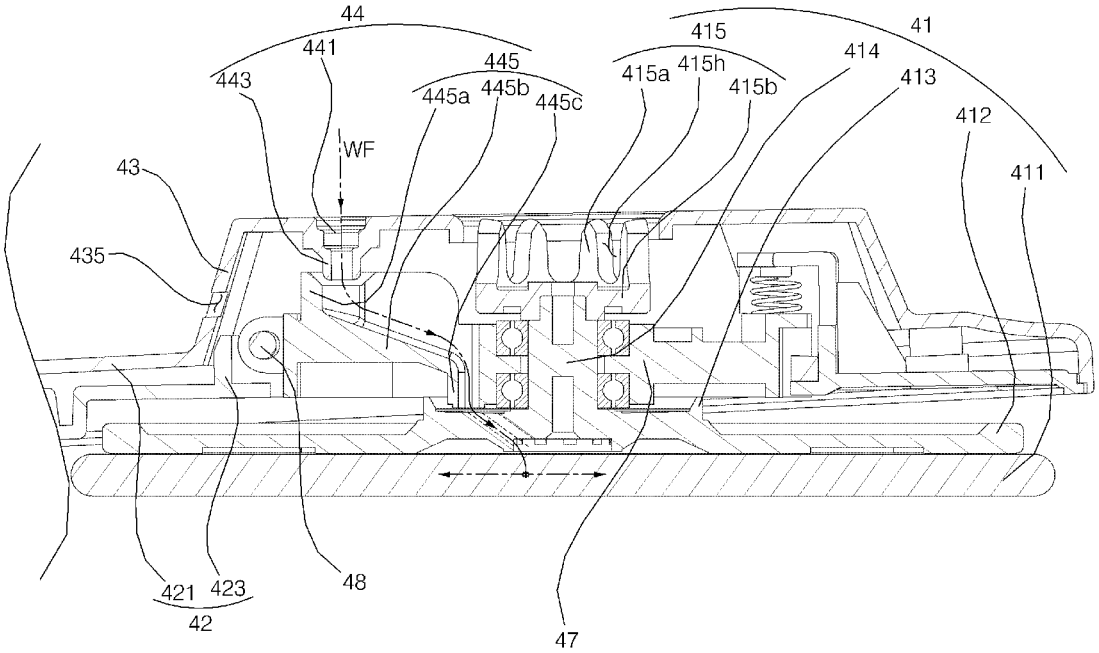
Figure 10:
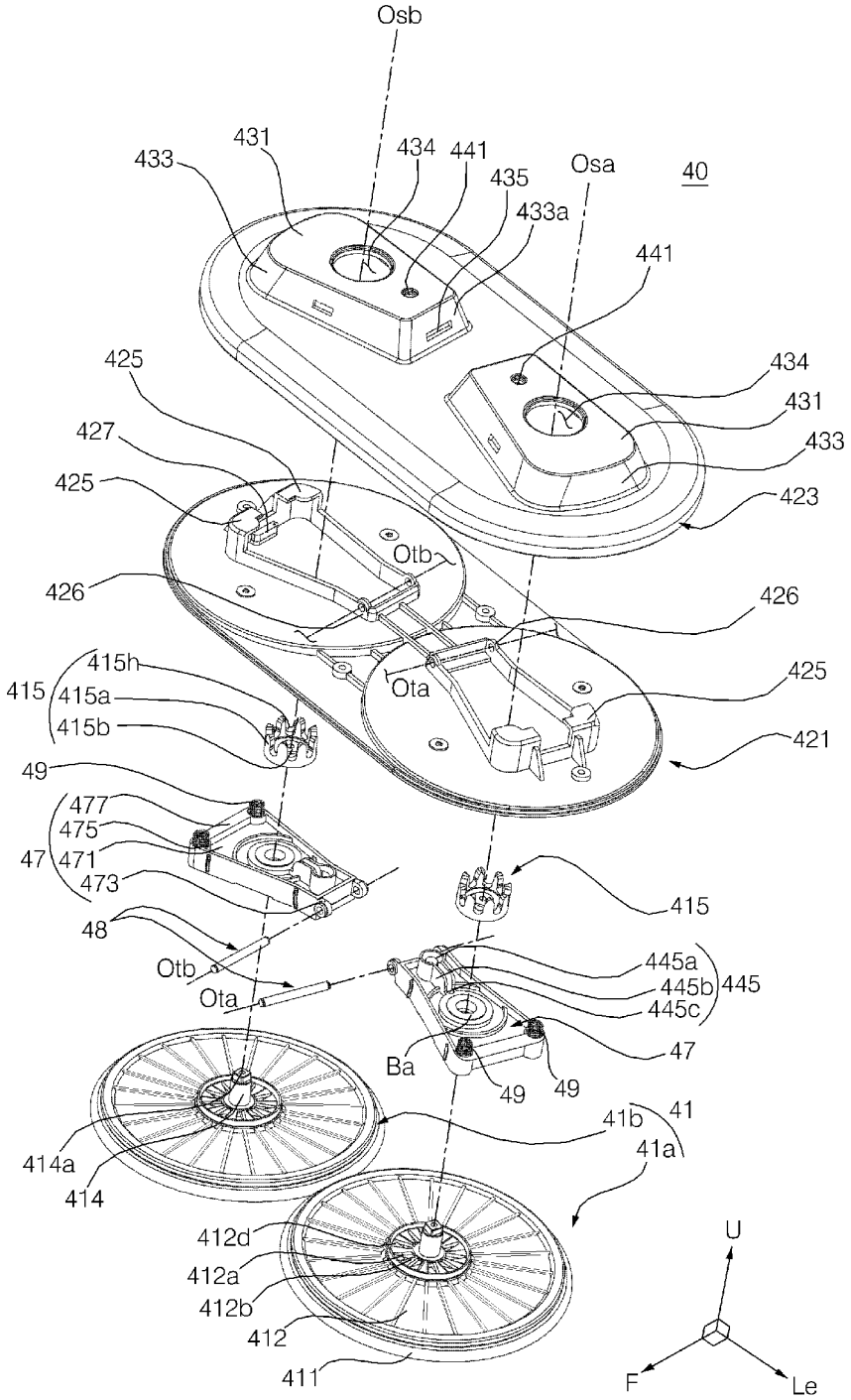
Figure 11:
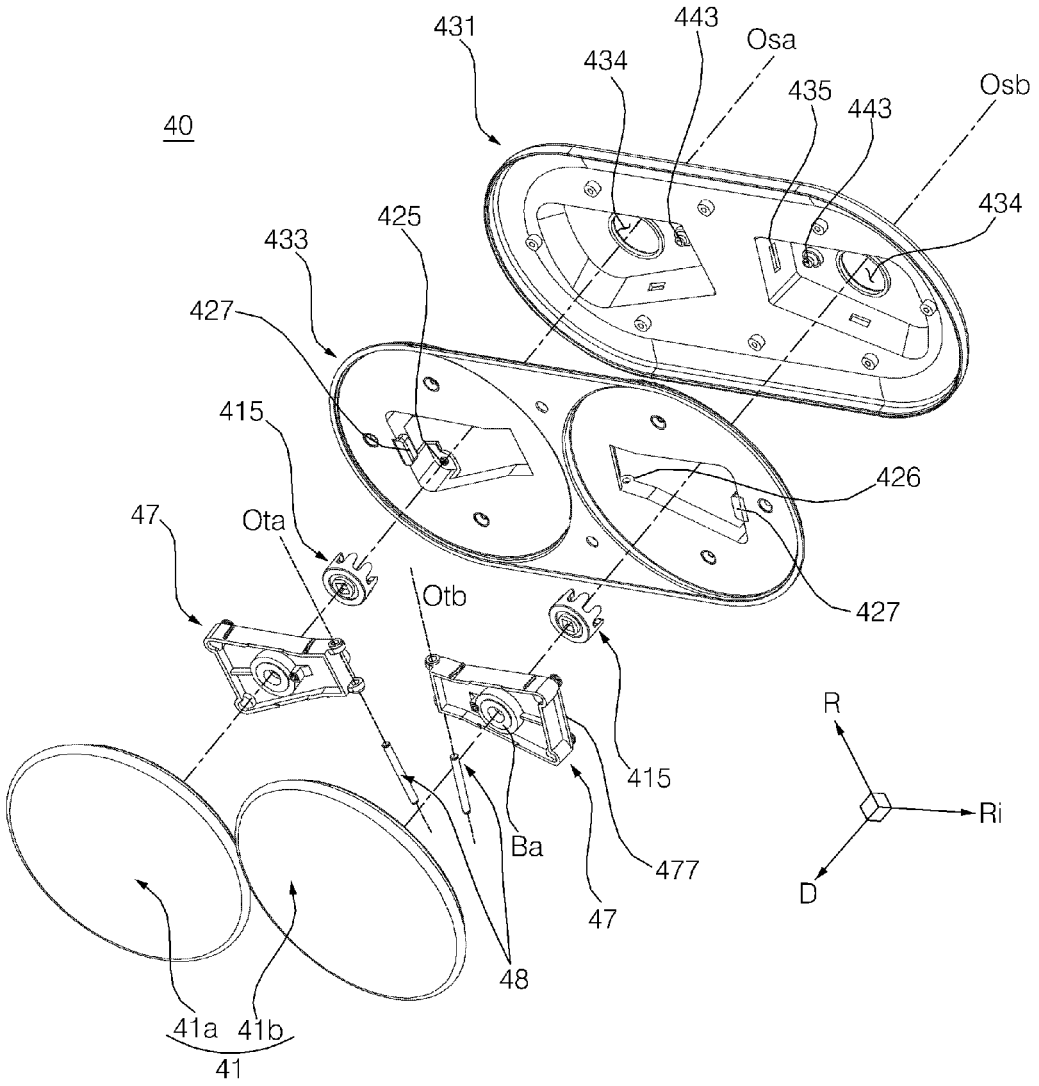
Figure 12:
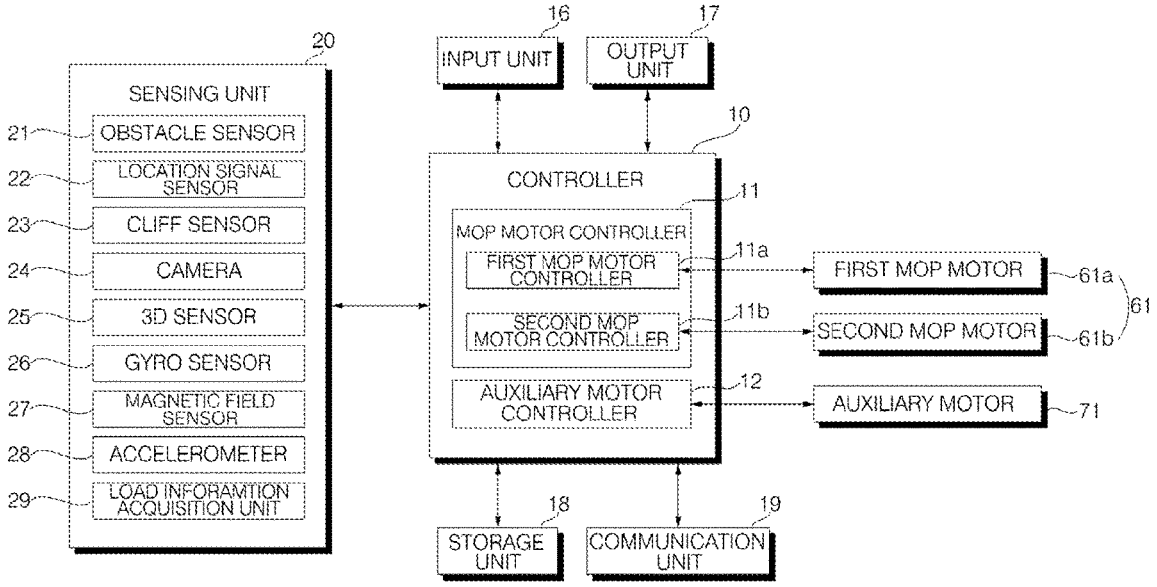
FIG. 12 is a control block diagram showing the cleaner 1 or 1' according to embodiments of the present invention.

The cleaner 1 includes a water supply module 80 that supplies water to the mop module 40. The water supply module 80 may supply water necessary for the mop module 40 or the auxiliary module 50. In FIGS. 8 and 9, a water flow direction WF is shown.

The water supply module 80 includes the water tank for storing water. The water tank 81 is disposed within the body 30. The water tank 81 is disposed at the rear side of the body 30. The water tank 81 may be disposed above the battery Bt.

The water tank 81 may be withdrawable to the outside of the body 30. The water tank 81 may be slidable to the rear of the body 30. There is provided a water engagement portion (not shown) that engages the water tank 81 with the body 30 when the water tank 81 is held within the body 30.

The water supply module 80 may include a water level display unit 83 that displays a water level of the water tank 81. The water level display unit 83 may be disposed at an exterior cover of the water tank. The water level display unit 83 may be disposed at a rear surface of the water tank. The water level display unit 83 may be formed of a transparent material, so that a user is able to see a level of water in the container 81.

The water supply module 80 includes a bump 85 that presses water in the water tank 81 so that the water moves to the mop module 40. The pump 85 is disposed in the body 30.

The water supply module 80 includes a water tank connector (not shown) that connects the water tank 81 and a supply pipe 86 when the water tank 81 is held within the body 30. Through the water tank connector, water in the water tank 81 flows into the supply pipe 86.

The water supply module 80 includes the supply pipe that guides movement of water from the water tank 81 to the mop module 40. The supply pipe 86 connects the water tank 81 and the water supply connector 87 to guide movement of water.

The water supply unit 86 includes: a first supply pipe 861 which guides movement of water from the water tank 81 to the pump 85; and a second supply pipe 862 which guides movement of water from the pump 85 to the mop module 40. One end of the first supply pipe 861 is connected to the water tank connector, and the other end thereof is connected to the pump 85. One end of the second supply pipe 862 is connected to the pump 85, and the other end thereof is connected to the water supply connector 87.

The second supply pipe 862 includes a common pipe (not shown) that guides movement of water from a relatively upstream side. Passing through the common pipe, water is split to the left-right directions at a three-way connector (not shown). The three-way connector forms a T-shaped flow path.

The second supply pile 862 includes: a first branch pipe 862*a* which guides movement of water to a water supply connector of a left-side module holder 36; and a second branch pipe 862*b* which guides movement of water to a water supply connector 87 of a right-side module holder 36. One end of the first branch pipe 862*a* is connected to the three-way connector, and the other end thereof is connected to a left-side water supply connector 87. One end of the second branch pipe 862*b* is connected to the three-way connector, and the other end is connected to a right-side water supply connector 87. Water flown into the left-side water supply connector 87 is supplied to the first mop unit 41*a*, and water flown into the right-side water supply connector 87 is supplied to the second mop unit 41*b*.

The water supply module 80 includes the water supply connector 87 that guides water in the water tank 81 to the mop module 40. Through the water supply connector 87, water moves from the body 30 to the mop module 40. The water supply connector 87 is disposed at the lower side of the body 30. The water supply connector 87 is disposed at the module holder 36. The water supply connector 87 is disposed at the bottom surface of the module holder 36. The water supply connector 87 is disposed at the bottom surface portion 361 of the module holder 36.

There is a plurality of water supply connectors 87 corresponding to the plurality of mop units 41*a* and 41*b*.

The water supply connector 87 protrudes from the module holder 36. The water supply connector 87 protrudes downward from the module holder 36. The water supply connector 87 is engaged with a water supply correspondence part 441 of the mop module 40, which will be described later. The water supply connector 87 forms a hole that penetrates in the upward-downward direction, and water moves from the body 30 to the mop module 40 through the hole formed at the water supply connector 87.

A water flow direction WF is described as below. Movement of water may be triggered by driving the pump 85. Water in the water tank 81 flows into the water supply connector 87 through the supply pipe 86. The water in the water tank 81 moves, by passing through the first supply pipe 861 and the second supply pipe 862, sequentially. Water in the water tank 81 flows into the water pipe correspondence part 411 of the mop module 40 by passing through the supply pipe 86 and the supply connector 87, sequentially. Water flown into the water supply correspondence part 441 flows into the water supply accommodation part 413 through the water supply transmission part 443 and the water supply induction unit 445. Water flown into the water supply accommodation part 413 passes through the water supply hole 412*a* and then flows into the central portion of the mop 411. Water flown into the central portion of the mop 411 moves to the edge of the mop 411 due to a centrifugal force caused by rotation of the mop 411.

The cleaner 1 includes the battery Bt that supplies power to the mop driving unit 60. The battery Bt may supply power to the auxiliary driving unit. The battery Bt is disposed at the body 30.

The cleaner 1 includes a detachment module 90 that makes the mop module releasably engaged with the body. In the coupled state, the detachment module 90 may make the mop module 40 released from the body 30. The detachment module 90 operates so that the mop module 40 and the body 30 are engaged and separated. In the separated state, the detachment module 90 may make the mop module 40 engaged with the body 30. The detachment module 90 may be disposed to cross a gap between the water tank 81 and the battery Bt.

A state in which the detachment module 90 makes the mop module 40 engaged with the body 30 may be indicated as a "engaged state." In addition, a state in which the detachment module 90 makes the mop module 40 released from the body 30 may be indicated as a "released state." The detachment module 90 is provided to switch one of the engaged state and the released state to the other.

The detachment module 90 includes at least one stopping part 915 that makes the mop module 40 releasably engaged with the body 30. The stopping part 915 protrudes from the body 30 to be engaged with the mop module 40. The detachment module 90 includes an operation unit 953 exposed to the outside. The operation unit 953 is exposed so that a user is allowed to touch the operation unit 953. The operation unit 953 may be allowed to be pressed from the outside of the body 30. The detachment module 90 may be provided to allow the stopping part 915 to make the mop module 40 released from the body 30 when the operation unit 953 is pressed upwards.

The detachment module 90 includes a stopping member 91 at which the stopping part 915 is disposed. A pair of stopping parts 915 may be disposed at each pair of stopping members 91*a* and 91*b*. The pair of stopping members 91*a* and 91*b* may be provided to correspond to a pair of module holders 36. The pair of stopping members 91*a* and 91*b* is disposed in the left-right direction. The detachment module 90 may include a restoring member (not shown), such as a spring, which restores the stopping member 91 from the released state to the engaged state. The detachment module 90 includes a moving member 95 that is slidably connected to the pair of stopping members 91*a* and 91*b*. The detachment module 90 includes a pressing member 95 at which the operation unit 953 is disposed. The pressing member 95 is slidably connected to the moving member 93.

The moving member 93 is provided to be capable of moving in the front and rear direction. The pressing member 95 is provided to be capable of moving in the upward-downward direction. The pressing member 95 and the moving member 93 are connected to each other, so that the moving member 93 moves backwards when the pressing member 95 moves upwards.

The pair of stopping members 91*a* and 91*b* are provided to be capable of moving in the left-right direction. The pair of stopping members 91 and 91*b* and the moving member 91 are connected, so that the pair of stopping members 91*a* and 91*b* moves in a direction in which the pair of stopping members 91*a* and 91*b* becomes close to each other when the moving member 93 moves backwards.

If the pair of stopping members 91*a* and 91*b* moves in a direction in which the pair of stopping members 91*a* and 91*b* becomes close to each other, the stopping part 915 is released from the mop module 40. The restoring member applies a restoring force to make the pair of stopping members 91*a* and 91*b* to move in a direction in which the pair of stopping members 91*a* and 91*b* becomes far from each other.

What is claimed is:

1. A cleaner capable of autonomously traveling while performing a mopping task, the cleaner comprising:

a body which defines an exterior of the cleaner;

at least one mop module which has at least one mop configured to be in contact with a floor, and is configured to support the body against the floor;

a tilt information acquisition sensor configured to acquire tilt information of the body in relation to the floor;

at least one specific part that comprises the at least one mop, is a part of the at least one mop module, and configured to be detachable from other parts of the cleaner, the body tilting in relation to the floor due to gravity while the at least one specific part is separated from the other parts; and a controller configured to:

based on at least the tilt information, determine whether a predetermined detachments condition is satisfied, the detachments condition being preset to be satisfied when the specific part is separated from the other parts; and control the cleaner to perform a predetermined mop separation error response operation when the detachments condition is satisfied.

2. The cleaner according to claim 1, wherein the detachments condition comprises a tilt condition that is preset such that satisfaction and unsatisfaction thereof is to be determined by comparing a tilt value corresponding to the tilt information with a predetermined reference tilt value.

3. The cleaner according to claim 2, further comprising:

a mop motor configured to provide a rotational force to the at least one mop; and a load information acquisition sensor which is configured to acquire load information of the at least one mop motor, wherein the detachments condition comprises a low load condition that is preset to be satisfied when a load value corresponding to the load information is less than a low load reference value, wherein the detachments condition is determined to be satisfied at least when the tilt condition and the low load condition are all satisfied.

4. The cleaner according to claim 2, wherein the tilt condition is preset to be satisfied when the tilt value is greater than a predetermined low limit reference tilt value and smaller than a predetermined high limit reference tilt value.

5. The cleaner according to claim 2, wherein the controller is further configured to, when the tilt condition is changed from a state in which the tilt condition is unsatisfied to a state in which the tilt condition is satisfied, control the cleaner to perform a predetermined avoidance operation.

6. The cleaner according to claim 5, wherein the cleaner reserves determination whether the detachments condition is satisfied until the avoidance operation is terminated by a predetermined standard.

7. The cleaner according to claim 6, further comprising:

a mop motor which is configured to provide a rotational force to the at least one mop; and a load information acquisition sensor which is configured to acquire load information to the mop motor, and wherein the controller is further configured to, after the avoidance operation is terminated by a predetermined standard, control the cleaner to perform the mop separation error response operation when a low load condition and the tilt condition are all satisfied, the low load condition is preset to be satisfied when a load value corresponding to the load information is relatively low, and not to be satisfied when the load value is relatively high.

8. The cleaner according to claim 1, further comprising:

a mop motor configured to provide a rotational force to the at least one mop; and a load information acquisition sensor which is configured to acquire load information of the mop motor, wherein the controller is further configured to:

based on at least the load information, determine whether a predetermined obstructed condition is satisfied, the obstructed condition is preset to be satisfied when the at least one mop is obstructed by an external obstacle; and when the obstructed condition is satisfied, control the cleaner to perform a predetermined mop obstruction error response operation which is different from a mop separation error response operation.

9. The cleaner according to claim 8, wherein the obstructed condition comprises:

a high load condition which is preset to be satisfied when a load value corresponding to the load information is relatively high, and not to be satisfied when the load value is relatively low; and a tilt condition which is preset such that satisfaction or unsatisfaction thereof is to be determined by comparing a tilt value corresponding to the tilt information with a predetermined reference tilt value, wherein the obstructed condition is preset to be satisfied at least when the tilt condition and the high load condition are all satisfied.

10. The cleaner according to claim 8, wherein:

the detachments condition comprises a tilt condition that is preset such that satisfaction or unsatisfaction thereof is to be determined by comparing a tilt value corresponding to the tilt information with a predetermined reference tilt value, the obstructed condition comprises the tilt condition, and the detachments condition and the obstructed condition are set to be different from each other.

11. The cleaner according to claim 1, wherein:

the at least one specific part comprises a plurality of different specific parts, the tilt information comprises information about a tilt value and a tilt direction, and the controller is further configured to, based on the tilt value and the tilt direction, recognize which specific part is separated among the plurality of different specific parts.

12. A cleaner capable of autonomously traveling while performing a mopping task, the cleaner comprising:

a body which defines an exterior of the cleaner;

a mop module which comprises a mop configured to be in contact with a floor, which is configured to support the body against the floor, and which is configured to be detachable from the body;

a tilt information acquisition sensor which is configured to acquire tilt information of the body in relation to the floor; and a controller configured to:

based on at least the tilt information, determine whether a predetermined detachments condition is satisfied, the detachments condition is preset to be satisfied when the mop module is separated from other parts of the cleaner; and control the cleaner to perform a predetermined mop separation error response operation when the detachments condition is satisfied, wherein the body tilts in relation to the floor due to gravity while the mop module is separated from the other parts of the cleaner.

13. A cleaner capable of autonomously traveling while performing a mopping task, the cleaner comprising:

a body which defines an exterior of the cleaner;

at least one mop module which comprises at least one mop configured to be rotatably in contact with a floor, and which configured to be coupled to the body;

at least one mop motor configured to provide a rotational force to the at least one mop;

a load information acquisition sensor which is configured to acquire load information of the at least one mop motor;

at least one specific part
comprises the at least one mop,
is a part of the at least one mop module, and
is defined such that the at least one specific part is configured to be detachable from other parts of the cleaner while the at least one mop motor is disposed at the other parts; and a controller configured to:
based on at least the load information, determine whether a detachments condition is satisfied, the detachments condition is preset to be satisfied when the specific part is separated from the other parts; and
when the detachments condition is satisfied, control the cleaner to perform a predetermined mop separation error response operation.

14. The cleaner according to claim 13, wherein the detachments condition comprises a low load condition that is preset to be satisfied when a load value corresponding to the load information is relatively low, and not to be satisfied when the load value is relatively high.

15. The cleaner according to claim 13, wherein the controller is further configured to:
based on at least the load information, determine whether a predetermined obstructed condition is satisfied, the obstructed condition is preset to be satisfied when the at least one mop is obstructed by an external obstacle; and
when the obstructed condition is satisfied, control the cleaner to perform a predetermined mop obstruction error response operation which is different from the predetermined mop separation error response operation.

16. The cleaner according to claim 15, wherein the obstructed condition comprises a high load condition that is preset to be satisfied when a load value corresponding to the load information is relatively high, and not to be satisfied when the load value is relatively low.

17. The cleaner according to claim 16, wherein:
the detachments condition comprises a low load condition that is preset to be satisfied when a load value corresponding to the load information is relatively low, and not to be satisfied when the load value is relatively high; and
the low load condition and the high load condition are preset not to be satisfied at the same time.

18. The cleaner according to claim 13, wherein:
the at least one mop comprises a plurality of mops;
the at least one mop motor comprises a plurality of mop motors which is configured to provide a rotational force to the plurality of mops, respectively;
the load information acquisition sensor acquires load information of each of the plurality of mop motors;
the at least one specific part comprises a plurality of different specific parts; and
the controller is further configured to recognize which specific part comprising which mop from among the plurality of mops is separated, based on the load information of each of the plurality of mop motors.

19. A cleaner capable of autonomously traveling while performing a mopping task, the cleaner comprising:
a body which defines an exterior of the cleaner;
a mop module which comprises a mop configured to rotate while in contact with a floor, and which is configured to be detachably coupled to the body;
at least one motor which is configured to a rotational force to the mop, and which is disposed at the body; and
a load information acquisitions or which is configured to acquire load information of the at least one mop motor,
wherein the cleaner further comprises a controller which is configured to:
based on at least the load information, determine satisfaction or unsatisfaction of a predetermined separated condition that is preset to be satisfied when the mop module is separated from the body, and
when the separated condition is satisfied, control a predetermined mop separation error response operation to be performed.

* * * * *